US006336707B1

(12) United States Patent
Asai et al.

(10) Patent No.: US 6,336,707 B1
(45) Date of Patent: Jan. 8, 2002

(54) RECORDING ELEMENT AND RECORDING DEVICE

(75) Inventors: Ichirou Asai; Koichi Haga; Shinobu Ozeki; Yoshiyuki Shiratsuki, all of Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 08/897,597

(22) Filed: Jul. 21, 1997

(30) Foreign Application Priority Data

Jul. 26, 1996 (JP) ..... 8-215036

(51) Int. Cl.[7] ..... B41J 2/135
(52) U.S. Cl. ..... 347/46; 347/54; 347/68
(58) Field of Search ..... 347/46, 68, 55, 347/54, 45

(56) References Cited

U.S. PATENT DOCUMENTS 2,512,743 A * 6/1950 Hansell ..... 347/46
4,603,338 A * 7/1986 Nakayama et al. ..... 347/55
4,706,098 A * 11/1987 Nakayama ..... 347/55
5,268,610 A * 12/1993 Hadimioglu et al. ..... 347/46
5,589,864 A 12/1996 Hadimioglu
5,801,730 A * 9/1998 Shima et al. ..... 347/55

FOREIGN PATENT DOCUMENTS

| | | | | |
|---|---|---|---|---|
| EP | 000387863 A2 * | 3/1989 | ..... | B05B/17/06 |
| JP | 62-085948 | 4/1987 | | |
| JP | 362111757 A * | 5/1987 | ..... | B41J/3/04 |
| JP | 2164546 | 6/1990 | | |
| JP | 2235644 | 9/1990 | | |
| JP | 3005150 | 1/1991 | | |
| JP | 4168050 | 6/1992 | | |
| JP | 8187853 | 7/1996 | | |

* cited by examiner

*Primary Examiner*—John Barlow
*Assistant Examiner*—Craig A. Hallacher

(57) ABSTRACT

A recording element and a recording device is disclosed which may stably eject very fine liquid drops without nozzles and with low frequency low voltage driving. The element of the present invention provides vibrators on a substrate. On the vibrators are provided elastic members. The elastic members have their tips in a sharpened form, plate-like form, or needle-like form. The free surface of liquid are positioned closer to the bottom side of the elastic members than the tip of the elastic members to drive the vibrators with an external driving means.

23 Claims, 19 Drawing Sheets

RECORDING ELEMENT AND RECORDING DEVICE

BACKGROUND OF THE INVENTION

1. Field of the Invention

The present invention relates to a recording element for ejecting drops of liquid such as ink drops to a surface to be printed, and a recording device which uses such element.

2. Description of the Related Art

A typical recording method for printing by ejecting drops of liquid, more specifically ink drops onto a surface to be printed uses nozzles. The nozzle type recording method to the date includes "on-demand" type and "continuous flow" type.

The on-demand type recording is a method that prints by ejecting ink intermittently from nozzles in response to recording information, exemplary types of this method include "piezoelectric vibrator" type and "thermal" type. The piezoelectric vibrator type operates, by applying pulsed voltage to the piezoelectric elements disposed in vicinity of ink chamber to distort it, for varying the liquid pressure of the ink in the ink chamber to eject ink drops from the nozzles to perform recording of dots on a recording medium paper. And the thermal type on-demand recording operates, by heating ink with a heater element provided in the ink chamber to form bubbles thereby to eject ink drops from nozzles to perform recording of dots on a recording medium.

On the other hand, in the continuous flow type, some pressure is applied to the ink to eject continuously from the nozzle, while at the same time vibration is applied by a vibrator such as the piezoelectric element to cause the projected ink column to be liquid drops, and charging and deflecting are selectively performed to the ink drops for recording.

FIG. 21 shows the overview of the piezoelectric vibrator type printing: a nozzle 72 is provided in one side of an ink chamber 71, while a piezoelectric element 73 is provided outside in the opposite side, and ink 74 is fulfilled in the ink chamber 71. By applying voltage to the piezoelectric element 73, which deforms such that its volume within the ink chamber 71 is to be minimized, to thereby increase the pressure in the ink chamber 71 to eject ink from the nozzle 72. In such printing method the diameter of the ejected ink drops will be determined mainly by the diameter of the nozzle 72.

FIG. 22 shows the overview of the thermal type printing: a nozzle 82 is provided in one side of an ink chamber 81, while a heater element 83 is provided within the ink chamber 81, and ink 84 is fulfilled in the ink chamber 81. By applying voltage to the heater element 83 to heat the heater element 83, ink nearby the heater element 83 is caused to be heated to form bubbles, to thereby increase the pressure in the ink chamber 81 to eject ink from the nozzle 82. In this method, similar to the piezoelectric vibrator type printing, the diameter of the ejected ink drops will be determined mainly by the diameter of the nozzle 82.

SUMMARY OF THE INVENTION

The resolution of the image to be printed in a variety of recording type had been required to be 300 dots per inch (dpi) in the prior art; recently, higher resolution such as 600 to 720 dpi has been required. In order to satisfy such a demand, the diameter of the dot on a recording medium paper has to be smaller, this follows that the diameter of the nozzle has to be smaller such that the diameter of the ink drops ejected become smaller.

However, when the diameter of the nozzle become smaller, blocking of nozzles by particles or dust, blocking of nozzles by dried ink surface in the nozzle, and further the change of the ink ejection direction by sticked ink sludge in the circumference of the nozzle may occur easily and some defects of the printing quality on the recording medium may be resulted. Therefore the diameter of the nozzle may not be small enough to the size needed to form a dot size corresponding to the required resolution.

There have been proposed some recording method for recording by ejecting ink drops onto the surface to be printed by using vibration or acoustic wave instead of nozzle in order to overcome such problems as cited above.

The first of the recording method without using nozzles in the prior art, as disclosed in the U.S. Pat. No. 4,308,547, is the printing method in which a piezoelectric element shell with concaved spherical surface is disposed in the ink, and voltage is applied thereto via electrodes. In this method, longitudinal longitudinal wave radiated from the piezoelectric element shell to the ink is concentrated to a point in a ink free surface for ejecting drops from the ink free surface.

Moreover, a similar type of printing as disclosed in the Japanese Published Examined Patent Application No. Hei 6-45233 as a method for improving the productivity and the fine structured precision, is the one in which a spherical concaved recess is provided on a substrate such as glass to form an acoustic lens, and a vibrator comprised of a piezoelectric element and electrodes for applying voltage to the piezoelectric element is formed on the other side of the substrate, then the vibrator is disposed in the ink. In this method, as similar to the method disclosed in the above cited U.S. Patent, the vibration from the vibrator is emitted as longitudinal wave in the ink, concentrated into a point on the ink free surface by means of the concaved acoustic lens for ejecting drops from the ink free surface.

In the Japanese Published Unexamined Patent Application No. Hei 3-200199, a method is disclosed in which a phased Fresnel lens in the form of thin film plate is provided on a substrate for a focusing lens less expensive but sharper. The phased Fresnel lens operates as a lens that plane incident wave is diffracted at a plurality of thin film plate disposed annularly spaced apart at a distance, then a plurality of radiated diffracted waves are combined in a point on the ink free surface to become maximum amplitude.

As mentioned above, the first of the recording method without using nozzles converges the vibration emitted from the vibrator into one point on the ink free surface to eject ink drops. The acoustic lens is made by forming a lens by the piezoelectric element itself, or by using a phased Fresnel lens for overlaying the same phase, or by using concaved lens. It should be noted that in the acoustic lens, since the relationship between the lens form and the convergence and divergence of wave is the reverse of that of the optical lens, a concaved lens should be used; the wave will be diverged with a convex lens.

Here, the diameter of ejected drop is approximately equal to the diameter of the converged bundle when longitudinal waves propagated in the ink are converged onto the ink free surface, and the converged diameter "d" will be $d \sim F/f$, where "f" is the driving frequency of the vibrator, "F" is the aperture value (F value) of the lens. The relation between the wavelength of the longitudinal waves propagated in the ink "$\lambda$" and its propagation speed "v" and the driving frequency "f" of the vibrator will be: $v=f\cdot\lambda$.

Thus, when for example, very fine ink drops of the drop diameter of approximately 15 micron is to be ejected, if the F value of the lens is 1, then the prior propagation speed of the longitudinal wave in the low viscosity water-based ink is approximately 1500 meters/sec., thus the driving frequency of the vibrator has to be set to a very high frequency such as approximately 100 MHz. Since the F value of the lens is, in practice, quite difficult to be significantly small due to many problems, in general, for the drop diameter "d" to be smaller, the vibrator is to be driven at a higher frequency.

As mentioned above, in the first printing method without nozzles as a plurality of vibrators have to be driven at a high frequency of near 100 MHz, a cost-related problem that the driving means becomes expensive may be resulted in, while other significant problems such as the change of the drop diameter by the variation of the ink viscosity due to the heating, or the blocking of ink ejection by the dried or solidified ink itself within a recording element, may occur.

The heating may be caused by the nature that the longitudinal wave propagated in the ink is highly attenuated in the ink if driven at higher frequency. Thus, the higher the frequency used, the larger the amount of energy absorbed in the ink due to the attenuation, and the larger the amount of heat.

In case of the recording element without using nozzles in the prior art, when this problem is to be overcome there are no way other than that a cooling mechanism is provided to the recording element, this leads to the growth of the size of the recording device and of the manufacturing cost. Therefore, a need has been existed for a recording element which may eject smaller ink drops without nozzles with lower frequency drive, and which generates less heat, as well as operates at higher energy efficiency.

As the second of the recording method without using nozzles, there is a method for ejecting ink drops by converging the vibration generated by a vibrator into a point on the ink free surface by using acoustic horn.

For example, in the above mentioned U.S. Pat. No. 4,308,547, there is disclosed that by converging vibration by an acoustic horn formed on the vibrator instead of the concaved lens, the vibration is applied to the ink thin film transported on a belt which is in contact with the tip of the acoustic horn for ejecting ink drops. Here the ejection force is generated at the tip of the acoustic horn.

Also, the Japanese Published Unexamined Patent Application No. Hei 4-168050 discloses, as shown in the FIG. 23, an acoustic collector 95 provided on a piezoelectric element 91. The acoustic collector 95 is formed on a vibrator 94 comprised of a piezoelectric element 91 and the electrodes 92 and 93 for applying voltage thereto, and is disposed in an ink reservoir 99 supporting ink 96. The acoustic collector 95 is in a form slightly tapered, as shown in the figure. In this example, the distortion incident from the bottom of the acoustic collector 95 is propagated in the acoustic collector 95 while its amplitude is amplified, the waves of a large amplitude which has been collected by the acoustic collector 95 hits the ink 96 so that the longitudinal wave thus generated will raise the ink free surface 97 to eject ink drop 98.

However, it should be noted that, in the specification of the U.S. Pat. No. 4,308,547 and the Japanese Published Unexamined Patent Application No. Hei 4-168050, either an acoustic collector or an acoustic horn is said to be used but its size, driving condition, and vibrating mode, as well as whether or not smaller drop may be obtained, are not mentioned.

Concerning the acoustic horn, in the field of acoustics in general, it is well known that for obtaining ejection force by vibrating the tip of collector (or horn) in large amplitude by resonance, the length (height) of the collector in the direction of vertical cross-section should be a multiple of the integer of the ½ wavelength of vibrating wave.

Thus, in the method of the prior art as shown in FIG. 23, in order to make the acoustic collector 95 smaller for manufacturing high density recording element, the wavelength of the vibrating wave has also to be shorter, thus the driving frequency of the vibrator 24 is required to be higher.

Therefore, in order to achieve a recording element of practical density, the vibrator is needed to be driven at a higher frequency ranging approximately from a few tens to 100 MHz, as similar to the first recording method without using nozzles. This follows that the attenuation of energy in the ink will be large and that the driving circuit will be expensive. Also, it is difficult in practice to securely transport ink thin film by a belt in contact with the tip of an acoustic horn, as taught in the specification of U.S. Pat. No. 4,308,547, and the diameter of ejected drop would not be stabilized.

There is the third recording method without using nozzles which uses electrostatic force as ejection force, i.e. electrostatic extraction method, and a variation which uses vibration for forming ink meniscus (ink protuberance) is known.

For example, in the Japanese Published Unexamined Patent Application No. Sho 62-222853, there is disclosed that a recording needle is projected from the ink surface to apply supersonic energy transmitted axially. According to the patent publication, because of acoustic streaming phenomenon, some ink in contact with the recording needle moves toward the direction to the tip of the needle to form ink meniscus in a convex form at the tip of the needle. In this state, electrostatic field is applied between the recording needle and the back electrode to cut out the ink to cause ink drop to be ejected onto a recording medium disposed between the recording needle and the back electrode. In this method, smaller ink drops may be formed in comparison with other methods because the ink meniscus is formed at the tip of the recording needle.

In addition, the Japanese Published Unexamined Patent Application No. Sho 56-28867 discloses an electrostatic extraction method that in the condition that the electrostatic field is applied between a recording needle electrode and a back electrode, image signal is applied to the needle electrode while at the same time the needle electrode is vibrated. In such a manner, the ink is said to be stably granulated.

However, the electrostatic method has its drawbacks such that the device becomes large and expensive, as the diameter of formed drop may vary in response to the variation of the thickness of the dielectric of the recording medium due to the humidity, and as supersonic also is required to be generated. In addition, high voltage regulating source is needed.

Therefore, the present invention provides a recording element and a recording device which uses no nozzle, may also eject very fine liquid drops, generate less heat and has higher energy efficiency by low frequency low voltage driving.

In the present invention, a recording element is provided, wherein the recording element having an elastic member with a part thereof in contact with liquid surface, by vibrating the elastic member, drops of the liquid being ejected from a portion of the elastic member projected from the liquid surface.

A recording device for performing printing by ejecting liquid drops from a recording element to a surface to be printed is provided, wherein the recording element having an elastic member with a part thereof in contact with liquid surface, by vibrating the elastic member, drops of the liquid being ejected from a portion of the elastic member projected from the liquid surface.

In the recording element of the present invention such constructed as mentioned above, by vibrating an elastic member, in the portion of the elastic member projected from the liquid surface, a large vibration energy is generated which may displace the projected portion while the liquid may be fed to the projected portion. Then the liquid supplied to the projected portion will be ejected as liquid drops, by the large vibration energy at the projected portion which may displace it.

DETAILED DESCRIPTION OF THE PREFERRED EMBODIMENTS

The present invention is an application of the phenomenon of drop ejection that the inventor has found as a result of experiments and consideration to a recording element which prints by ejecting liquid drops onto a surface to be printed. Before showing various practical embodiments of the present invention, the basic structure and the operational principle of the recording element according to the present invention will be described below.

Figure 1:
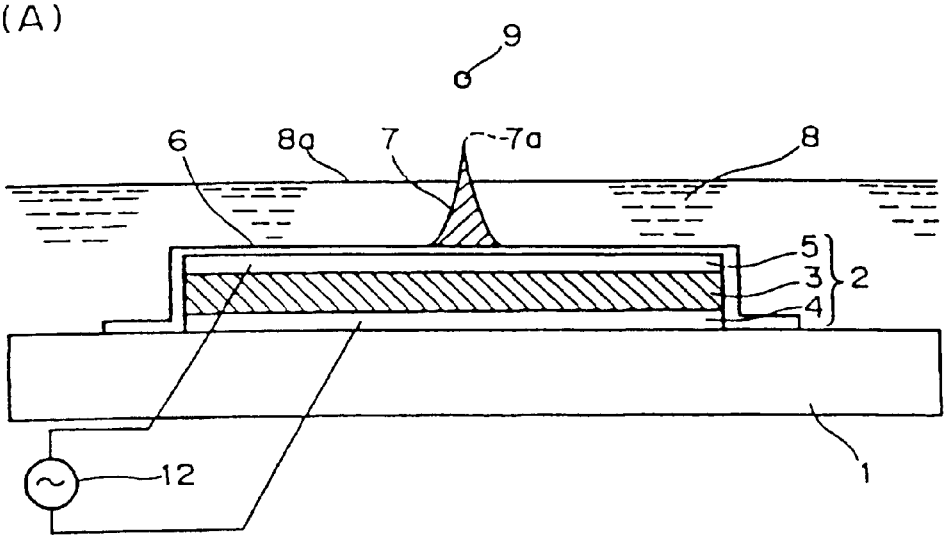
FIG. 1 shows a sectional view and a plain view indicating one example of the basic structure of the recording element according to the present invention, and a second sectional view of another example of the basic structure of the recording element.
Figure 1:
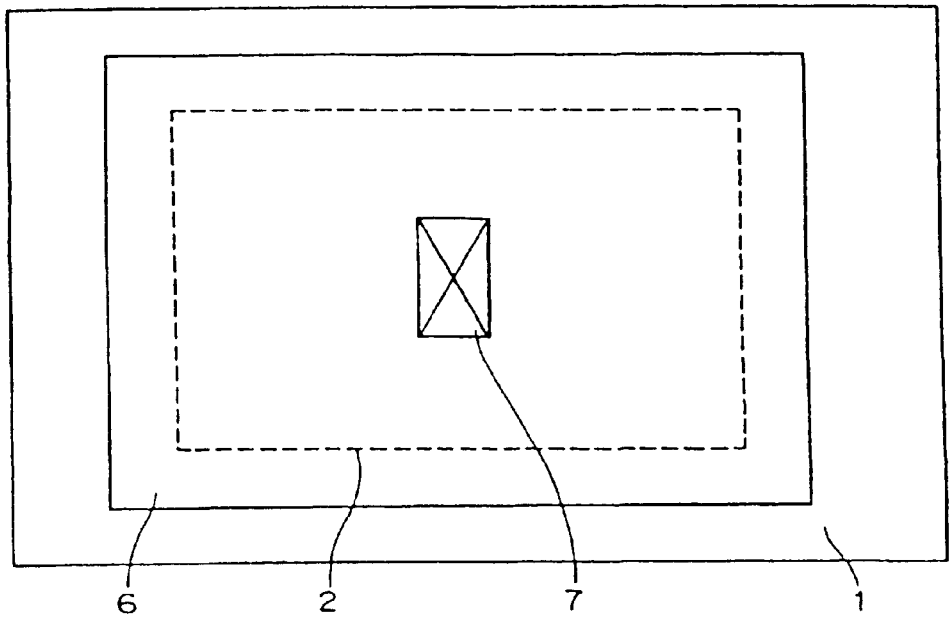
Figure 1:
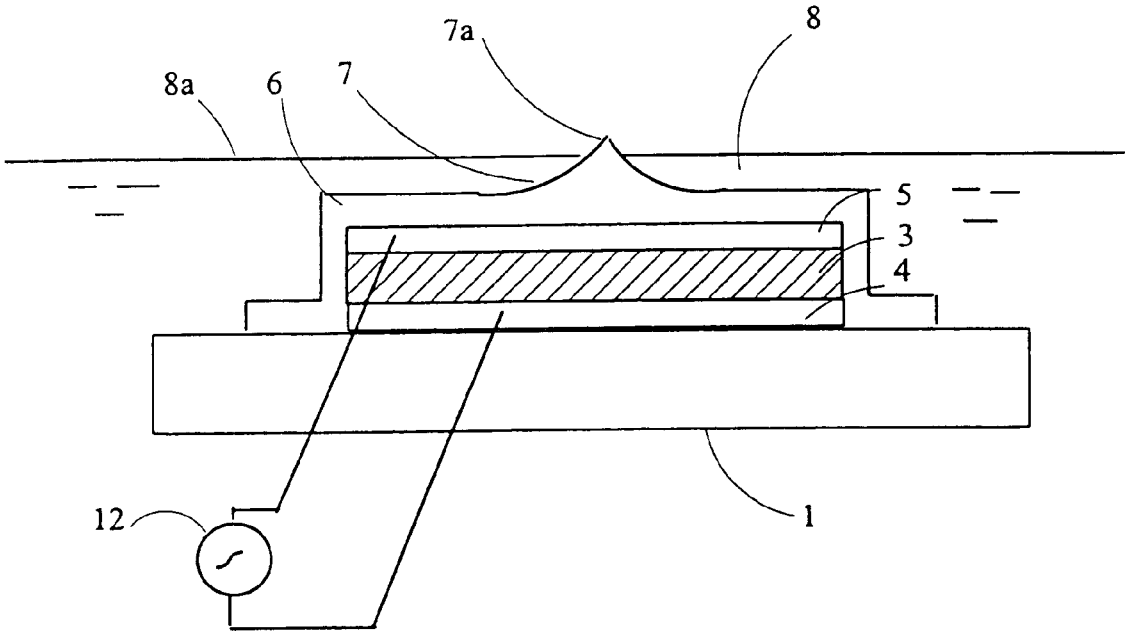

FIG. 1 shows one example of the basic structure of the recording element according to the present invention. FIG. 1A shows a cross-sectional diagram, and FIG. 1B shows a plain view. Here ink and ink drops are omitted in the FIG. 1B.

The recording element in this embodiment comprises a vibrator 2 as vibration generator means on a substrate 1, and an elastic member 7 formed on the vibrator 2. Ink 8 is fulfilled such that its free surface 8*a* is disposed between the tip 7*a* of the elastic member 7 and the bottom. The vibrator 2 is driven by external driving means 12. Here the elastic member 7 is in a form of sharpened tip in this embodiment. The substrate may be omitted if the vibration generating means may support the vibrator. FIG. 1(C) shows that the vibrator 2 and the elastic member 7 are integral.

In the actually constructed embodiment, a piezoelectric ceramic thin film 3 of PZT (lead zirconic acid titanate), and electrodes 4 and 5 for applying voltage thereto are formed on a substrate 1 of brass. On the vibrator 2 comprised of piezoelectric ceramic thin film 3 and electrodes 4 and 5, an elastic member 7 made from resin cyanoacrylate is formed with a protection film 6 of $SiO_2$ therebetween. The ink 8 is filled such that the tip 7*a* of the elastic member 7 protrudes 100 micron from the ink free surface 8*a*. The protection film 6 is used for isolate vibrator 2 from the ink 8.

The elastic member 7 in this embodiment is approximately in a form of pyramid, that the cross-sectional form normal to the plane of the substrate 1 is tapering from the bottom to the tip 7*a*. The bottom plane is a rectangular with one boundary being 400 micron and another 800 micron. The hight is 400 micron. The tip 7*a* is such that the cross-sectional area become small enough, as discussed later.

The term "link free surface" is a superficial surface of the ink which has the plane surface form. The ink free surface designates to the ink surface made solely by the gravity, which is not affected by other objects. The ink surface in contact with the elastic member 7 is not a ink free surface because it is curved, as discussed later. The ink 8 is a black, water-based ink having viscosity of 2mPa·s.

The vibrator 2 comprised of piezoelectric ceramic thin film 3 and electrodes 4 and 5 has its inherent resonance frequency $f_0$, determined by the thickness and piezoelectric characteristics of the piezoelectric ceramic thin film 3, as well as the size, hardness, etc. of connected elastic member 7. Therefore, the vibrator 2 may be excited by applying a voltage of the frequency f equal to this $f_0$ or the multiple integer of $f_0$ to the vibrator 2. In this embodiment the vibrator 2 is excited at 242 kHz. It should be noted that the driving frequency may be taken any value, however efficient vibration may be obtained at the resonance frequency $f_0$ or a frequency f at the multiple integer of the $f_0$.

Alternative current (AC) voltage of 242 kHz sine wave was applied in practice to the vibrator 2 as burst wave during 100 microseconds to cause vibration in the vertical direction in FIG. 1A, i.e., direction perpendicular to the paper medium surface of FIG. 1B to apply vibration to the elastic member 7. At the 30V p-p driving voltage, ink drops 9 was ejected, from the tip 7*a* of the elastic member 7, to the direction approximately perpendicular to the free surface 8*a*. The diameter of the ink drops 9 was 15 micron.

When continuously applying AC voltage, relatively large continuous ink column is ejected, and when applying burst waves, fine ink drops 9 are ejected. Here the burst wave means intermittent AC voltage comprised of one or more waveforms. By using burst wave, AC voltage of short duration may be applied to the vibrator 2 while maintaining the frequency f equal to or integer multiple of the resonance frequency $f_0$. Therefore the vibrator 2 is driven with burst waves. Burst waves may not only consist of sine waves, but also of square waves or triangular waves.

Figure 2A:
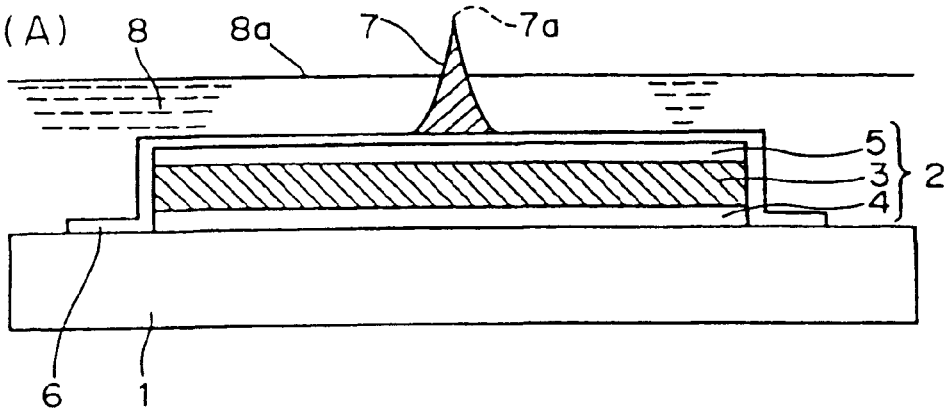
FIG. 2 shows a mode in which ink drops are ejected from the recording element shown in FIG. 1.
Figure 2B:
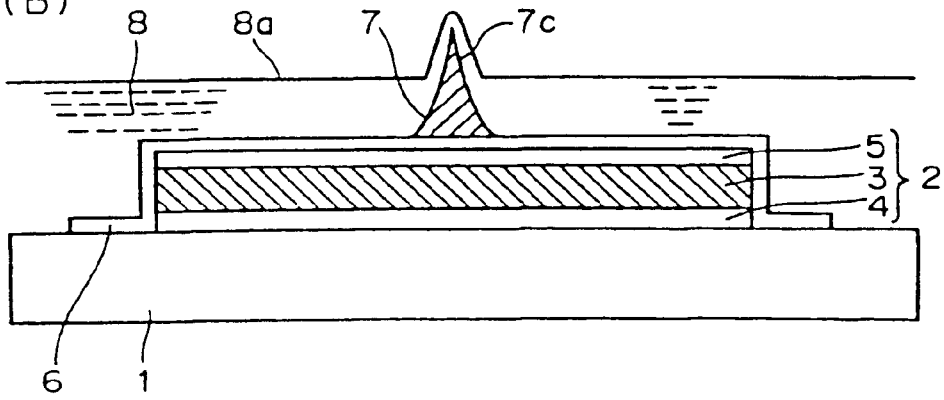
Figure 2C:
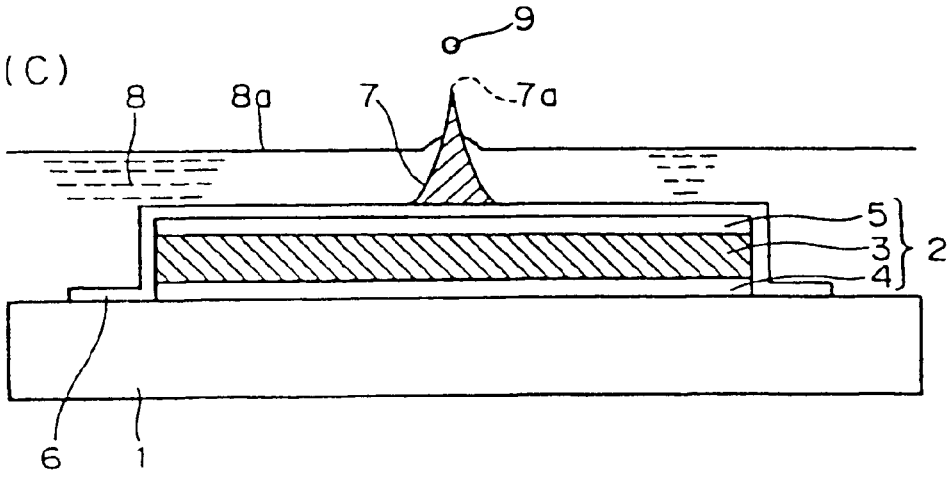

In order to understand the above cited phenomenon, observation with high speed camera was performed. In the resting state of the vibrator 2, as shown in FIG. 2A, the tip 7*a* of the elastic member 7 projects above the free surface 8*a*. When applying burst wave voltage during short period of time to the vibrator 2, as shown in FIG. 2B, ink was observed to flow up along with the side wall 7*c* of the elastic member 7. When ink was supplied to the tip 7*a* of the elastic member 7 by the streaming, as shown in FIG. 2C, ink drops 9 were ejected immediately from the tip 7*a* of the elastic member 7. The ink flow is considered to be a result of acoustic streaming or of surface tension.

The "acoustic streaming" is a phenomenon that, when supersonic (vibration) with the intensity exceeding a predetermined level is radiated to a fluid, the fluid, which serves as medium for propagating the vibration, moves itself, and a flow of the fluid occurs.

Figure 3A:
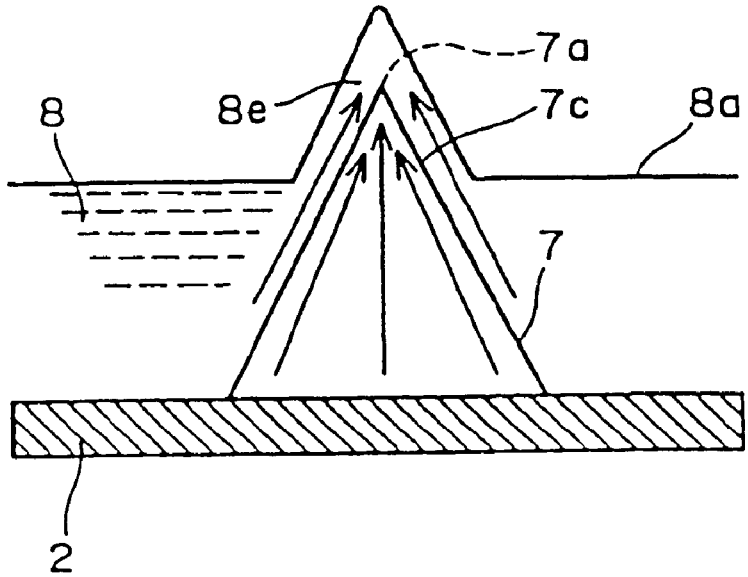
FIG. 3 is a schematic diagram illustrating the operational principal of the present invention.

In case of the present invention, the vibration generated in the vibrator 2 propagates inside of the elastic member 7, as shown in FIG. 3A, while at the same time vibration component along with the side wall 7*c* of the elastic member 7 is generated, by which it is possible that a part of ink 8*e* in contact with the side wall 7*c* of the elastic member 7 may be flowed.

Figure 3B:
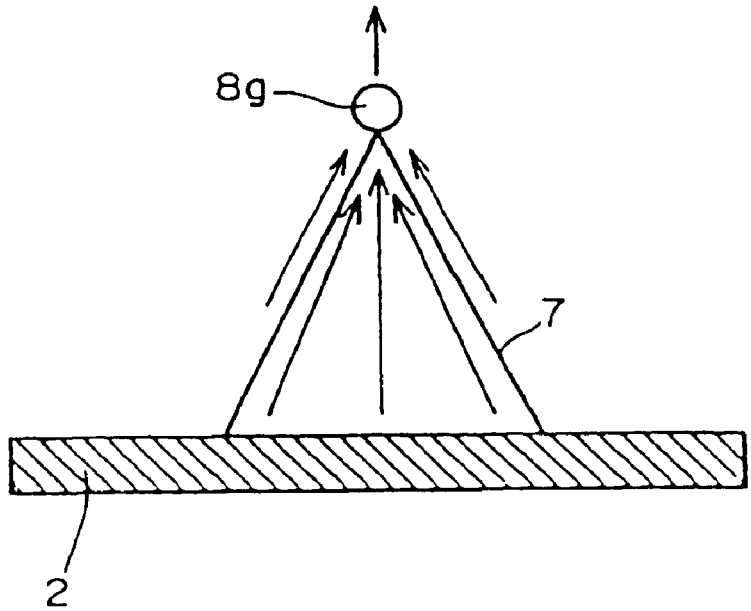

Another experiment was conducted as shown in FIG. 3B. By retaining a drop of ink 8*g* at the tip of ejection needle, and approaching it to the tip of the elastic member 7. When some vibration energy was applied to the elastic member 7, the drop of ink 8*g* was blown out from the tip of the elastic member 7 to the upward direction at the moment of contact with the tip of the elastic member 7. No ink drop was ejected when contacting the drop of ink 8*g* to other portions of the vibrator 2 without elastic member 7.

The above experiments shows that, for ejecting ink drops, ink may be allowed not to exist at the side wall 7*c* of the elastic member 7, and further, the flow of ink may be allowed not to be at the side wall 7*c*. In summary, the principal force for ejecting ink drops is the wave energy which, after propagating the elastic member 7, largely displaces the tip 7*a* at the tip 7*a* of the elastic member 7.

Figure 23:
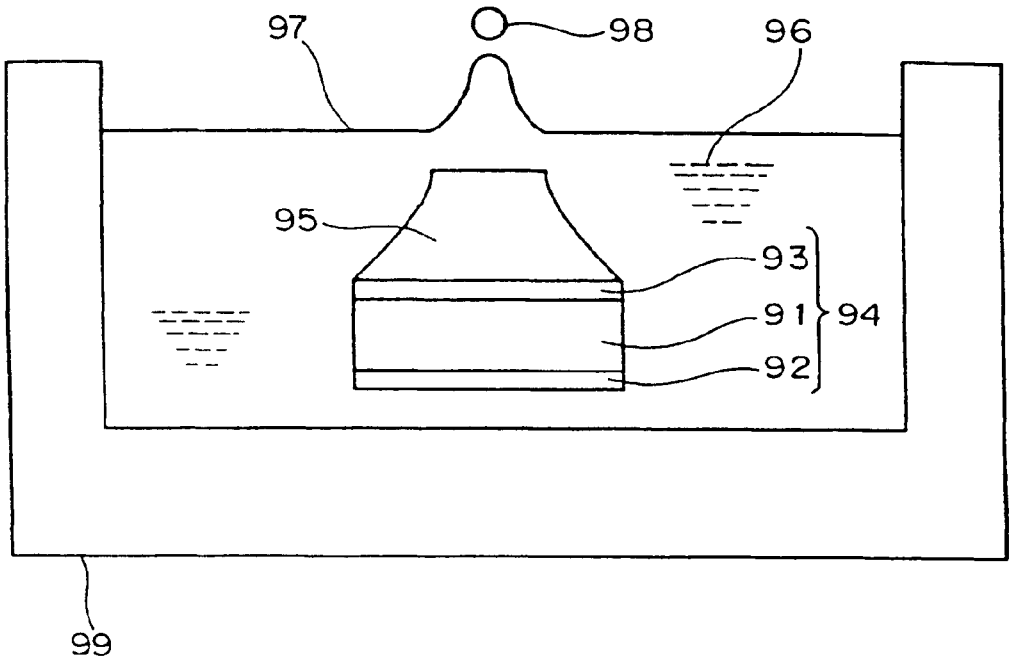
FIG. 23 shows one exemplary embodiment of recording element using no nozzle of the prior art.

Therefore, in order to merely eject ink drops, it will be sufficient to provide a acoustic collector 95 on a piezoelectric element 91 and to dispose them in the ink 96, as disclosed in the Japanese Published Unexamined Patent Application No. Hei 4-168050 and as shown in FIG. 23. However with this structure it was found to be difficult to a single fine ink drop in practice. The details will be explained below.

Figure 4:
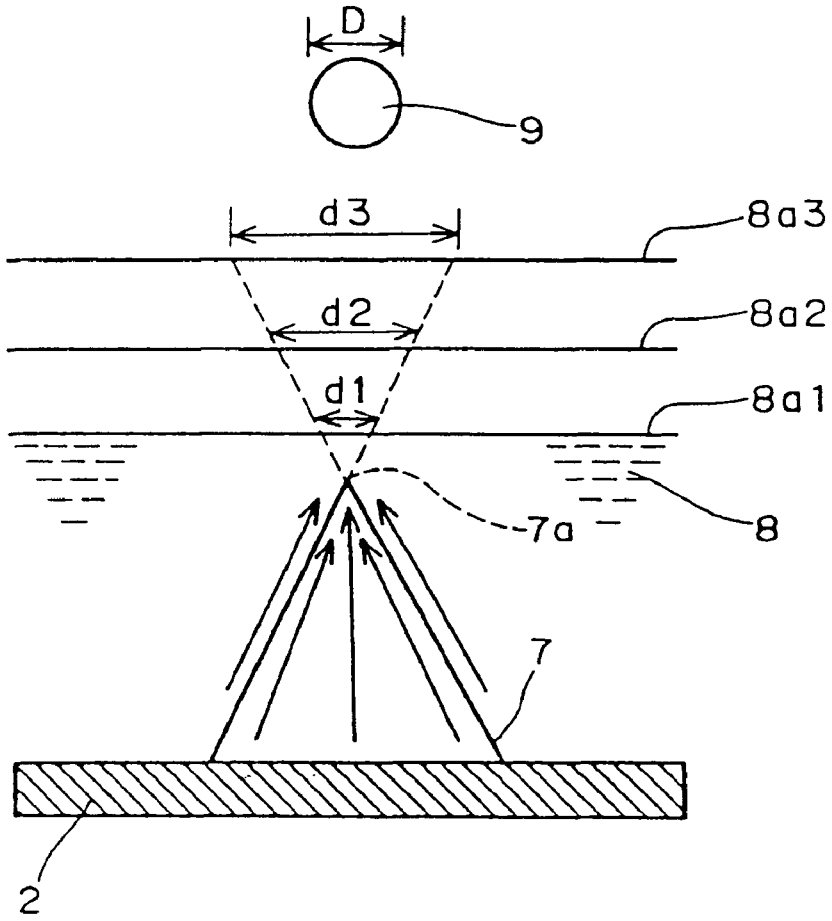
FIG. 4 shows the relationships between the tip of an elastic member and ink free surface.

FIG. 4 depicts an embodiment in which the elastic member 7 is embedded in the ink 8. As shown in the figure, when gradually raising the ink free surface to the levels 8*a*1, 8*a*2 and 8*a*3 in this sequence, the diameter D of the ejected ink drops became larger. This has been resulted because although the vibration energy input from the vibrator 2 propagates through the elastic member 7 to lead to the large displacement at the tip 7*a* of the elastic member 7, if the ink free surface is far away from the tip 7*a* then the vibration dissipates again into the ink 8, and consequently the side "d" of the affecting area in the ink free surface becomes also larger in the order of d1, d2, and d3. Naturally as the energy intensity of the wave affecting to the ink 8 also decreases, input electric power for ejecting ink drops 9 must be increased accordingly.

Therefore, in order to eject finer ink drops, it is sufficient to bring the ink free surface close to the tip 7*a* of the elastic member 7. In practice, however, there may be problems in such a case.

At first, the ink free surface in the vicinity of the elastic member 7 may be disturbed by the reaction of ejection at the time of ejection of the ink drops 9. In this case, if the tip 7*a* of the elastic member 7 is embedded in the ink 8 in the resting state, this reaction disturbs a relatively large surface area of the ink free surface. Thus a sufficient amount of time between one ejection of the ink drops 9 to another is required to be taken, and consequently, this slows down the repeated ejection speed, hence the printing speed.

At second, in case in which the ink free surface is at the same level to or slightly above the tip 7*a* of the elastic member 7, a quantity of ink already exists in the periphery of the tip 7*a* of the elastic member 7, so that the diameter of ejected drops and the direction of ejection is likely subject to be altered at the time of ejection of the ink drops 9, because the portion of ink which is to become ink drops 9 is pulled by the ink in the vicinity.

Therefore, in the structure as disclosed in the Japanese Published Unexamined Patent Application No. Hei 4-168050 and as shown in FIG. 23, in which the whole acoustic collector 95 is embedded in the ink 96, it is difficult to stably eject a single fine ink drop. That is, at the moment of ejection, it is preferred that ink does not exist at the circumference of the tip 7*a* of the elastic member 7 as much as possible. It should be noted that the problems as cited above does not almost occur as discussed later, if the ink free surface is below the tip 7*a* of the elastic member 7 but if a small quantity of ink is spread in the vicinity of the tip 7*a* of the elastic member 7 by for example surface tension.

The structure of the present invention in which ink 8 is supplied by streaming to the tip 7*a* of the elastic member 7, a single fine ink drop may be stably formed with high reproductivity. Thus according to the present invention, as shown in FIG. 3, as a small quantity of ink in a form of thin film is supplied to the tip 7*a* of the elastic member 7 each time the ejection occurs, a fine ink drop is ejected, while the disturbance of the ink free surface along with the ejection as well as the effect of the neighboring ink will be very small.

Thus according to the present invention, by protruding the tip 7*a* of the elastic member 7 above the ink free surface 8*a*, ink 8 may be allowed to be flew, and by the virtue that the ink supplied to the tip 7*a* of the elastic member 7 is served to the formation of ink drops, fine ink drops are stably ejected from the tip 7*a* of the elastic member 7.

In addition, the present invention has a feature that the diameter of ink drops do not depend on the position of the free surface 8*a*. Since among the nozzle-less recording method of the prior art, the ones using wave energy or electrostatic energy eject fine ink drops by converging wave energy or electrostatic energy into a point in the ink free surface, the diameter of ink drops may easily vary as the position of ink surface (depth) varies.

In contrast, according to the present invention, fine ink drops may be ejected if and only if the tip 7*a* of the elastic member 7 is protruded above the ink free surface 8*a,* and the diameter of ink drops is unlikely to be varied even though the position of ink free surface 8*a* (depth) varies. This is because a small quantity of ink is supplied to the tip 7*a* of the elastic member 7 by streaming for each ejection, and a part of ink thin film 8*e* in contact with the tip 7*a* is ejected at the moment of supply, at the tip 7*a,* by the wave energy which significantly displaces it.

However, in case in which the free surface 8*a* protrudes above the tip 7*a* of the elastic member 7, or conversely, in case the free surface 8*a* is significantly separated downwardly away from the tip 7*a* of the elastic member 7, this may not be applied. The former case have been described above with reference to FIG. 4. However in the latter case, there may be likely to occur the phenomenon that the ink drops are not ejected due to the lack of the amount of required ink supplied to the tip 7*a* of the elastic member 7.

As mentioned above, from the viewpoint of the driving frequency, in comparison with the method of the prior art using lens and requiring such high driving frequency as few hundreds MHz, the present invention may eject fine ink drops by using no lens, and requiring much lower driving frequency of approximately few hundreds kHz.

Thus by applying the drop ejecting phenomenon that the inventor has been found as a result of experiments and consideration to a recording element for printing by ejecting ink drops to the surface to be printed, the present invention may obtain the effect to (1) eject such fine ink drops as the diameter of 15 micron, (2) use much lower driving frequency of approximately few hundreds kHz so that no expensive driver for high frequency driving is needed, (3) allow to stably eject fine ink drops since the diameter of ejected drops is not almost varied, (4) decrease the amount of heat generated in the ink, and (5) observe no decreasing reliability by the ink solidified in the head.

In case of acoustic horns used for mechanical processing, the acoustic horn is supplied with vibration to cause a large amplitude of the change of position to be generated at the tip for use in the process. In the field of acoustics, in general, it is known that a large amplitude of waves may be obtained by efficiently propagating the vibration if the size (the length in the direction of advancing waves) of the acoustic horn is more than ½ of the wavelength of the vibration waves (c.f., C. Chiba, "supersonic spraying", Sankaido publishing, pp73, 1990).

However, in the present invention, the size of the elastic member 7 (length in the direction of advancing waves) is smaller than the one wavelength (or ½ wavelength) of the vibration waves propagating in the elastic member 7. For example, in case in which the excitation is done when f=242 kHz, as mentioned above, since the speed "v" of acoustic longitudinal waves propagating within the elastic member 7 is approximately 3000 meters/sec., by the relation $v=f\cdot\lambda$, then the wavelength $\lambda$ of the longitudinal waves propagating within the elastic member 7 will correspond to 12.4 mm (since the speed "v" of the waves in the ink 8 is approximately 1500 meters/sec., the wavelength $\lambda$ of the waves in the ink 8 will correspond to 6.2 mm). Further, since the length in the vertical direction (height) of the elastic member 7 used in the present invention is, approximately 400 micron as stated above, significantly smaller than one wavelength (or ½ wavelength) of the vibration waves as longitudinal wave.

However the present invention may eject fine ink drops even though the elastic member 7 is so small. This is probably because not only the longitudinal wave but also shear wave component in the elastic member is thought to be participated in the ink drop ejection, as stated above.

In the present invention, fine ink drops may be ejected. According to the present invention and in the recording element thereof, each ejection point having vibrator 2 and elastic member 7 as shown in FIG. 1 respectively, may be disposed in relatively high density. Thus according to the present invention, both the low frequency drive and the high density disposition, which are the problems to be solved in the recording element without using nozzles, are solved at once.

In the present invention, for ejecting stably a single fine ink drops, the form of the elastic member 7 and the relative positioning between the tip 7*a* of the elastic member 7 and the free surface 8*a* are indispensable. The details will be described below.

The shape of the elastic member 7 is preferably sharpened, or plate or needle like form at the point portion including its tip 7*a*. If the point is not in such shape, the positional change at the point will be small so that very large driving power will be required for large change of the point by the wave energy as stated above.

Figure 5A:
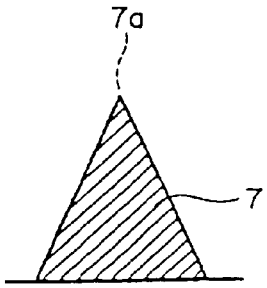
FIG. 5 shows examples suitable for elastic member and examples not suitable for elastic member.
Figure 5B:
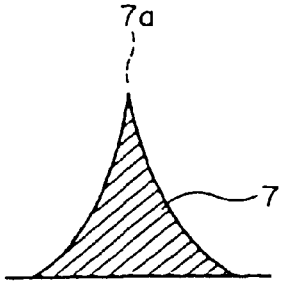
Figure 5C:
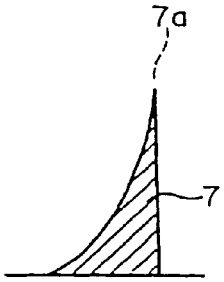
Figure 5D:
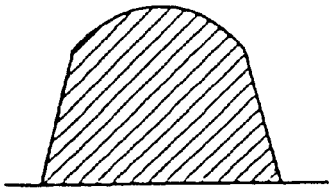
Figure 5E:
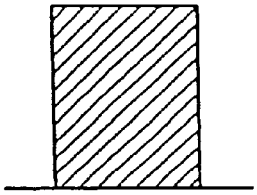
Figure 6A:
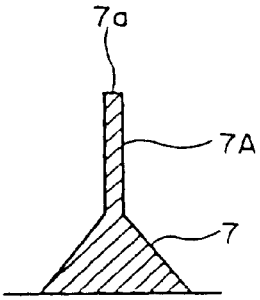
FIG. 6 shows a preferred example for elastic member.
Figure 6B:
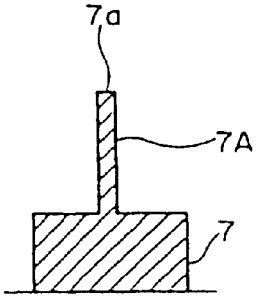
Figure 6C:
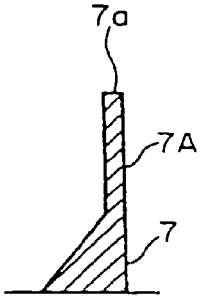
Figure 6D:
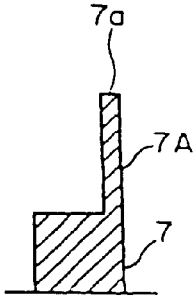

FIGS. 5A, 5B, and 5C show examples of cross-sectional shape suitable for the elastic member 7, each one of which are tapered from the bottom of the elastic member 7 toward the sharpened point in the cross-section. In contrast, as shown in FIGS. 5D and 5E, broadened point are not suitable for the elastic member 7, which may reduce the positional change at the point, so that very large driving power will be required for vibrating the member.

Furthermore, as shown in FIGS. 6A, 6B, 6C or 6D, points 7A including the tip 7*a* which is plate or needle like shape are suitable for the elastic member 7 because they may be driven with much less voltage.

Figure 7A:
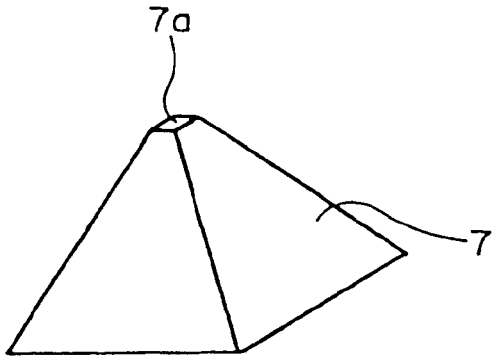
FIG. 7 shows another preferred example for elastic member.
Figure 7B:
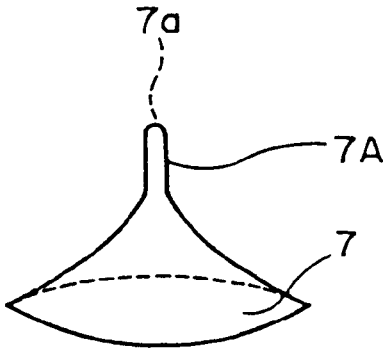
Figure 7C:
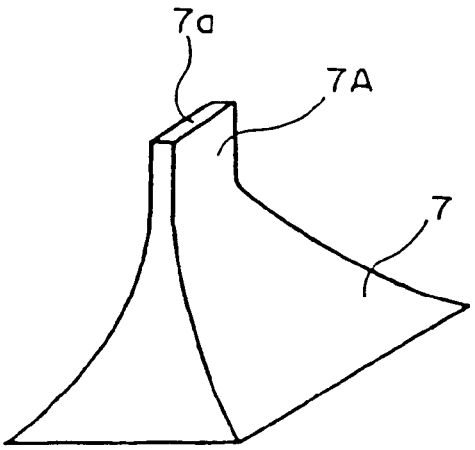
Figure 7D:
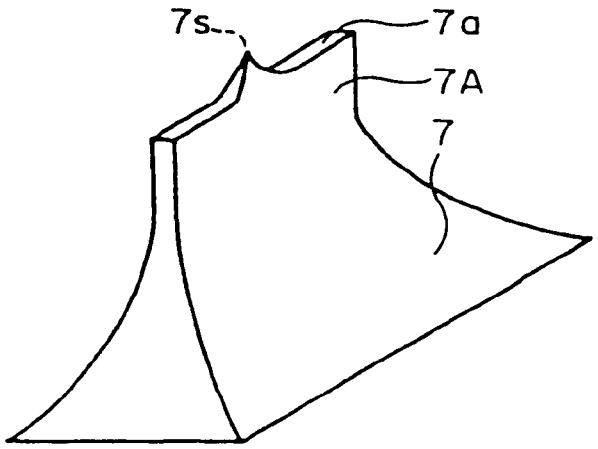

Thus in the overall shape of the elastic member 7 including the shape in the direction of depth, for example, pyramidal shape as whole as shown in FIG. 7A, shape having bottom of corn shape and needle like point as shown in FIG. 7B, shape with plate like tips as shown in FIG. 7C or D, are suitable for the elastic member 7.

It should be noted that in the shape with plate like point 7A as shown in FIG. 7C, if the length of the plate, i.e., the length of the tip 7*a* is large then ink drops are likely to be ejected from a plurality of points in the direction of the length of the tip 7*a*. Thus when making the point portion 7A in a plate like form, and if the length of the plate like portion is relatively long, a protrusion 7*s* which forms a singular point should be formed at a predetermined position in the direction of the length of the tip 7*a*.

When the protrusion 7*s* was formed a single fine ink drop was stably ejected from only the protrusion 7*s*. However the ejection of ink drops from other than the protrusion 7*s* of the tip 7*a* was observed when driving voltage was high. Therefore by adjusting driving voltage, stable ejection of a singular fine ink drop only from the protrusion 7*s* may be achievable even when the length of the plate like portion of the point 7A.

For the size of the tip 7*a,* when the elastic member 7 is driven with vibration of hundreds kHz and ink drops of the diameter of 15 micron are intended to be ejected, if the boundary width and length of the tip 7*a* is less than 15 micron, the positional change in the tip 7*a* may be increased and ink drops of the predetermined size are likely to be ejected. Since the driving voltage is required to be high when the boundary width and length of the tip 7*a* is large, the boundary width and length of the tip 7*a* should be preferably as small as possible.

Figure 8A:
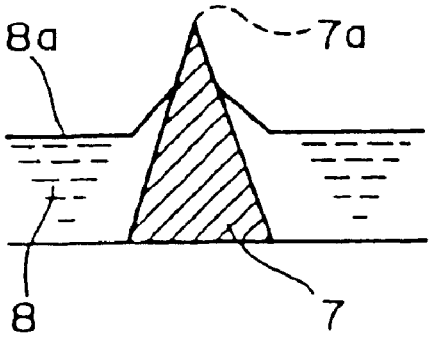
FIG. 8 shows the relationships between the tip of an elastic member and ink free surface.
Figure 8B:
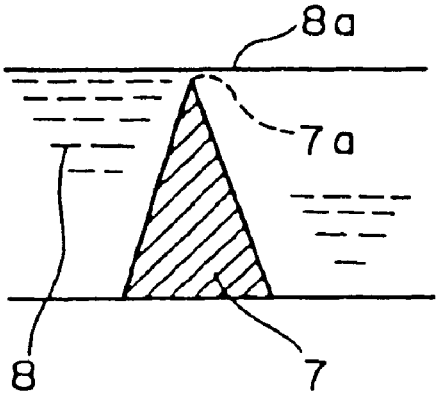
Figure 8C:
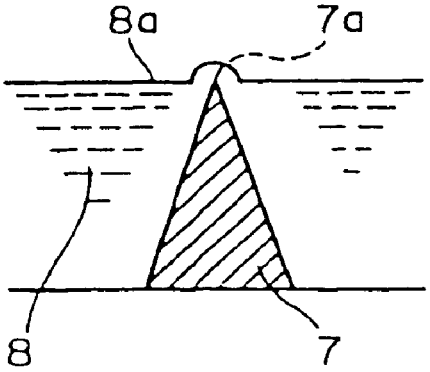

For the relative positional relationship between the elastic member 7 and the ink free surface 8*a,* in order to eject a single fine ink drop according to the present invention, the tip 7*a* of the elastic member 7 has to be positioned above the ink free surface 8*a* as shown in FIG. 8A. The positions as shown in FIG. 8B or 8C of the tip 7*a* of the elastic member 7 beneath or at the same height of the ink free surface 8*a* are not suitable due to the reasons as stated above.

Figure 8D:
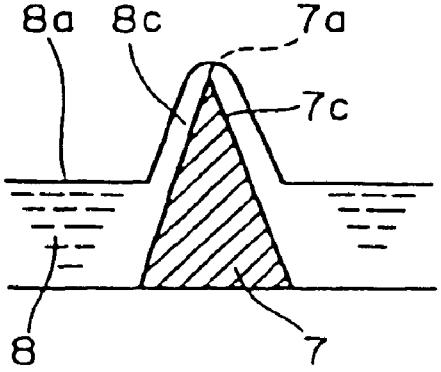

However, if the ink free surface 8*a* is far below from the tip 7*a* as shown in FIG. 8D, a small amount of ink may be held by its surface tension, at the side wall 7*c* of the point portion including the tip 7*a,* as ink thin film 8*c*. However ink drops to be ejected will be somewhat larger in comparison with the FIG. 8A, for the amount of ink held in advance at the tip. Also when ejecting ink drops the ejection may be likely to be affected by the surrounding ink. Thus in this case the amount of ink covering the tip should be held as small as possible.

It is also important that the surface of the elastic member 7 has wetness for the ink in order for ink drops to be stably ejected. If the surface of the elastic member 7 is not easy to be wet with ink, the supply of ink to the tip 7*a* may become difficult. The wetness with ink may be controlled, so as to accommodate the surface condition of the elastic member 7 to the ink, or ink physics according to the surface of the elastic member 7.

As described above, the shape and material of the elastic member 7 have to be determine by considering the vibration frequency "f", amplitude, and driving voltage of the vibrator 2, the distance of the tip 7*a* of the elastic member 7 from the ink free surface 8*a,* as well as the viscosity and surface tension of the ink 8.

In the present invention nozzle may not be needed to be used for regulating the size of drops, however, any member having openings larger than the diameter of the ejected drops may be disposed in any part of the ink free surface 8*a* in order to stabilize the ink surface or to reduce drying of ink.

The elastic member 7 may be made from a variety of resins such as cyanoacrylate resins, epoxy resins, or fluorine resins. Also, inorganic materials such as $SiO_2$, SiON or Sin, AlN, and $Al_2O_3$, may be used for the elastic member 7. Metals such as Al, Fe, Ti, Cr, Au, Mo, and TiW, and alloy thereof may also be used for forming the elastic member 7, provided that the surface of alloy in contact with the ink 8 is preferably protected by inorganic film of such materials as $SiO_2$ so as not to be corroded. Needless to say that more than two materials among resins, inorganic materials, and metals may be used. The tip portion and the bottom of the elastic member 7 may be formed from different materials in condition that the vibration energy is efficiently propagated.

The piezoelectric ceramic thin film 3, most important member in the vibrator 2 for vibrating the elastic member 7, may be formed with a piezoelectric substrate or with a piezoelectric film. In addition the piezoelectric element may be formed not only in single layer but also in multiple layers. For the piezoelectric element, polycrystals or monocrystals such as crystals, PZT, barium titanate $BaTiO_3$, niobic acid lead $PbNb_2O_6$, $Bi_{12}GeO_{20}$, niobic acid lithium $LiNbO_3$, and lithium tantalic acid $LiTaO_3$, or piezoelectric thin films such as ZnO and AlN, or piezoelectric polymers such as polyurea, PVDF (poly vinylidene fluoride), and copolymers of PVDF, or complex of inorganic piezoelectric material such as PZT and piezoelectric polymers may be used. Upon designing a recording device, the optimal piezoelectric material must be selected according to the driving frequency. Ceramics such as PZT may be used if the AC frequency applied is ranging between tens of kHz and 1 MHz, a piezoelectric thin film corresponding to higher frequency such as ZnO has to be selected when driven with higher frequency. In any case, a material having vibration characteristics sufficient for bring vibration to the vibrator 2 is required. The elastic member 7 may be formed from the same piezoelectric material forming the vibrator 2.

The preferred embodiments of the above description will be presented below in greater details.

Figure 9:
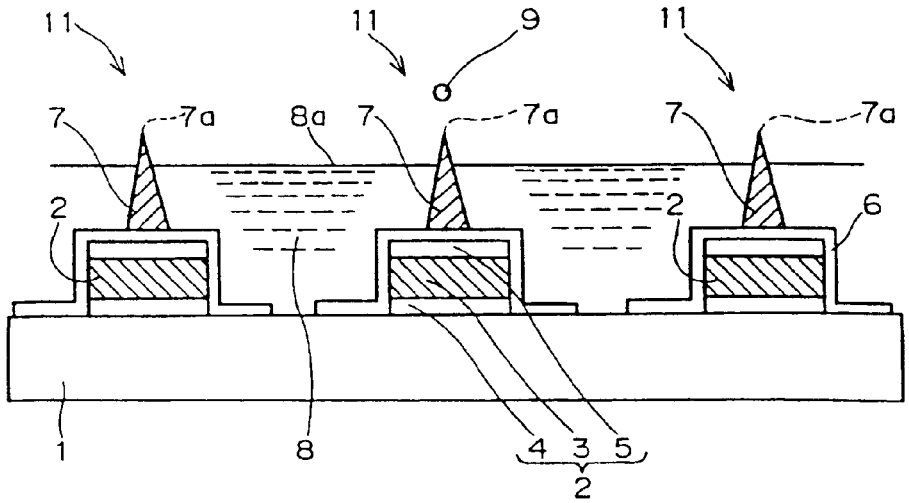
FIG. 9 shows one embodiment of the recording element according to the present invention.

[first embodiment: FIG. 9]

FIG. 9 shows the principal members of the first embodiment of the recording element according to the present invention.

In this embodiment, the vibrators 2 are formed by depositing Ag electrode 4 of thickness of 1 micron on a substrate 1 of brass having thickness of 500 micron, and patterning thereafter, then depositing the piezoelectric ceramic thin film 3 of PZT (lead zirconic acid titanic acid) of thickness of 100 micron, and patterning thereafter, then subsequently depositing the electrodes 5 formed in two layers of 0.05 micron thickness Cr and 1 micron thickness Au and patterning thereafter.

The piezoelectric ceramic thin film 3 made of PZT is polarization processed so as to vibrate in the direction perpendicular to the film plane when a voltage is applied across the electrodes 4 and 5. The electrode 4 is a common electrode common for each vibrator 2, and the electrodes 5 are address electrodes for vibrating specific vibrator.

Thereafter, the vibrator 2 made of piezoelectric ceramic thin film 3 and electrodes 4 and 5 is coated by a protection film 6 of such material as $SiO_2$ of thickness of 1 micron, followed by forming elastic member 7 of cyanoacrylate resin, in the pyramidal form of triangular cross-section, the base of 150 micron boundary, and the hight of 200 micron, on each vibrator 2.

The elastic members 7 are formed by using a mold by forming a concave recess in fluorine resin which is not wet with the cyanoacrylate resin thus not likely to be adhered thereto. The method of forming elastic members 7 in this embodiment as well as embodiments as discussed later, is not limited thereto, process technique using lithography employed in the semiconductor processing, thick film printing technique, or a variety of forming techniques used in the manufacturing process of micromachines, may be applied to the forming of the elastic member 7 made of not only resins but also of inorganic materials or metal.

Similar in later embodiments, the paired vibrators 2 and elastic members 7 constitute ejectors 11 for ejection of ink drops. The distance between the tip 7*a* of a elastic member 7 and the ink free surface 8*a* of the ink 8 is 50 micron such that the tip 7*a* of the elastic members 7 may protrude above the ink free surface 8*a*. Then by using AC power source (not shown) to externally apply a voltage of frequency "f" equal to the resonance frequency $f_0$ or a multiple of integer thereof, defined by along with the stiffness of the substrate 1 to the vibrator 2 in order to excite the vibrator 2.

Similar in later embodiments, one or more ejectors among a plurality of ejectors are selectively applied with a voltage. In this embodiment, a voltage of 40V p-p, 242 kHz was burstly applied during the period of time of 100 microseconds. As a result, the ink drops 9 of the size (diameter) of 15 microns were ejected from above the vibrators selected by the address electrodes 5.

In this embodiment, as no nozzle is disposed on the ink surface, it will be needless to say that there was no ink solidified around the nozzle or therewithin, fine ink drops were stably ejected. Since driving frequency is lower, with no heat, the problems such as change of viscosity or solidification of the ink 8 did not occur.

Like other embodiments, similar results were obtained with the vibrators 2 with the elastic members 7 being not sharpened but arranged in the plate-like form or needle-like form.

Figure 10:
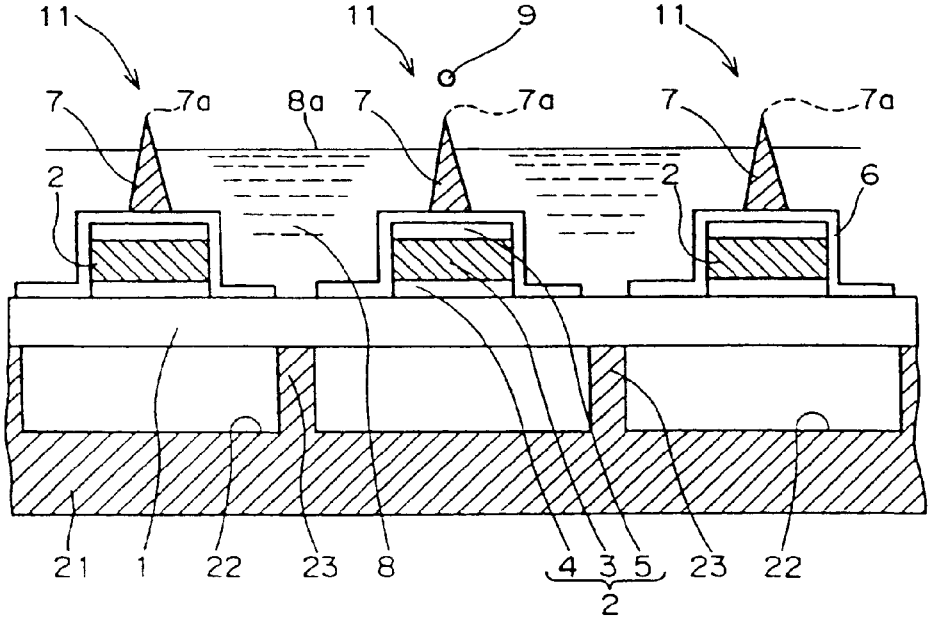
FIG. 10 shows another embodiment of the recording element according to the present invention.

[second embodiment: FIG. 10]

FIG. 10 shows the principal members of the second embodiment of the recording element according to the present invention. This embodiment is made by joining the underneath side of the substrate 1 to a support 21 at the periphery of respective vibrators 2, in the recording element of the first embodiment shown in FIG. 9.

In this embodiment, vibrators 2 are formed by depositing Ag electrode 4 of thickness of 1 micron on a substrate 1 of brass having thickness of 500 micron, and patterning thereafter, then depositing the piezoelectric ceramic thin film 3 of PZT (lead zirconic acid titanic acid) of thickness of 100 micron, and patterning thereafter, then subsequently depositing the electrodes 5 formed in two layers of 0.05 micron thickness Cr and 1 micron thickness Au and patterning thereafter.

The piezoelectric ceramic thin film 3 made of PZT is polarization processed so as to vibrate in the direction perpendicular to the film plane when a voltage is applied across the electrodes 4 and 5. The electrode 4 is a common electrode common for each vibrator 2, and the electrodes 5 are address electrodes for vibrating specific vibrator.

Thereafter, the vibrators 2 made of piezoelectric ceramic thin film 3 and electrodes 4 and 5 are coated by a protection film 6 of such material as $SiO_2$ of thickness of 1 micron, followed by forming elastic members 7 of cyanoacrylate resin, in the pyramidal form of triangular cross-section, the base of 150 micron boundary, and the height of 200 micron, on each of the vibrators 2.

The elastic members 7 are formed by using a mold by forming a concave recess to fluorine resin which is not wet with the cyanoacrylate resin thus not likely to be adhered thereto. As stated above, the elastic members 7 may be formed by using other technique, similar to the first embodiment.

In this embodiment, by processing a member 21 of ceramics, recesses 22 corresponding to each vibrator 2 on the substrate 1 and supports 23 positioned therebetween are formed, then the substrate 1 and the vibrators 2 are adhered at the underneath side of the substrate 1 by using the supports 23 as contact points or fixing points. Each of the recesses 22 is not closed space, a part thereof should communicate with ambient air. It may be possible not to communicate it with air in case in which there might occur problems when communicating with air, similar in other embodiments. The member 21 will become a support supporting the substrate 1.

The distance between the tip 7*a* of the elastic members 7 and the ink free surface 8*a* of the ink 8 is 50 micron such that the tip 7*a* of the elastic members 7 may protrude above the ink free surface 8*a*. Then by using AC power source (not shown) to externally apply to the vibrators 2 a voltage of frequency "f" equal to the resonance frequency $f_0$ or a multiple of integer thereof, defined by along with the stiffness of the substrate 1, in order to excite the vibrators 2.

Similar in later embodiments, one or more ejectors among a plurality of ejectors are selectively applied with a voltage. In this embodiment, a voltage of 40V p-p, at 242 kHz was burstly applied during the period of time of 100 microseconds. As a result, the ink drops 9 of the size (diameter) of 15 microns were ejected from above the vibrators selected by the address electrodes 5.

Also in this embodiment, as no nozzle is disposed on the ink surface, it may be needless to say that there was no ink solidified around the nozzle or therewithin, fine ink drops were stably ejected. Since driving frequency is lower, with no heat, the problems such as change of viscosity or solidification of the ink 8 did not occur.

Furthermore, in this embodiment, there is a recess 22 under each vibrator 2, and the vibrators 2 are supported by the support 23 at their circumference so that each of the vibrators 2 may be easily vibrated independently, while stably ejecting ink drops without being affected by the distortion of the substrate 1 due to the vibration of neighboring vibrators.

The shape of recesses 22 may be defined by considering the form of vibrators 2. However, for generation of stable and uniform vibration, a polygon is preferable, and a round is more preferable.

Figure 11:
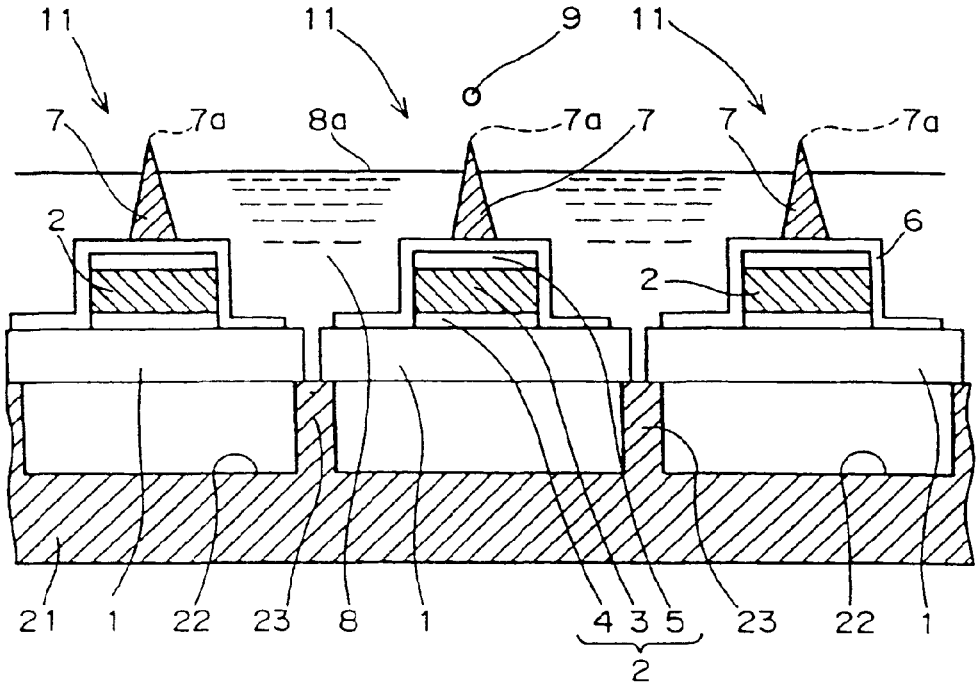
FIG. 11 shows still another embodiment of the recording element according to the present invention.

[third embodiment: FIG. 11]

FIG. 11 shows the principal members of the third embodiment of the recording element according to the present invention. This embodiment is similar to the recording element of the second embodiment shown in FIG. 10, except for a substrate 1 separated for each vibrator 2. The method of manufacturing is basically the same as the second embodiment.

In this embodiment, the substrate 1 supporting vibrators 2 are split for each vibrator 2 and each supported by the supports 23, so that each vibrator 2 may vibrate with higher efficiency and higher precision than the second embodiment while the effect from the neighboring vibrators may be reduced.

Figure 12A:
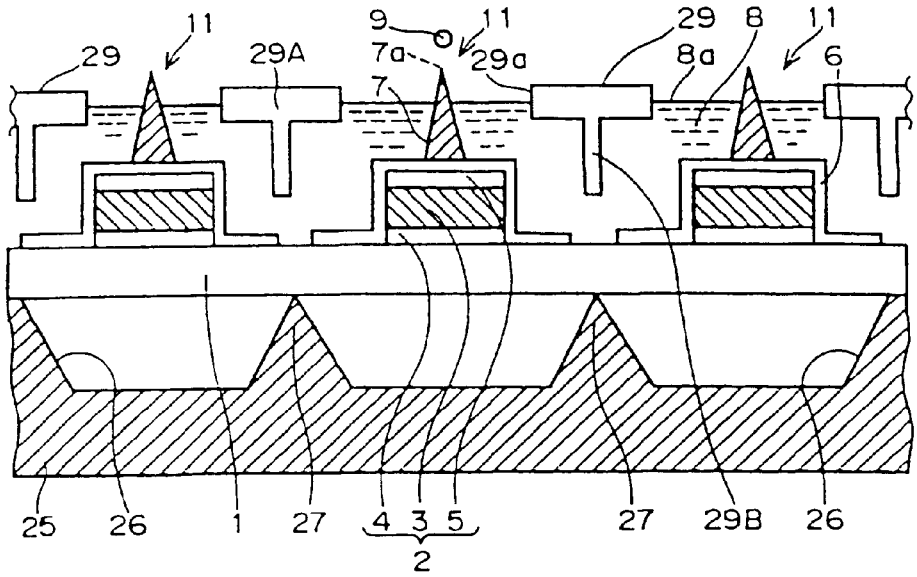
FIG. 12 shows yet another embodiment of the recording element according to the present invention.
Figure 12B:
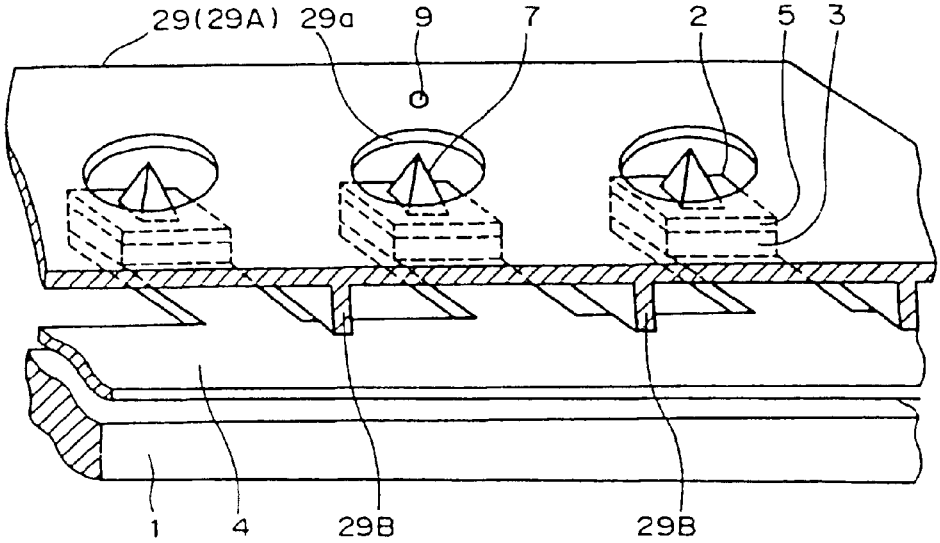

[fourth embodiment: FIG. 12]

FIG. 12 shows the principal members of the fourth embodiment of the recording element according to the present invention. This embodiment is made on the recording element of the second embodiment shown in FIG. 10 with supporting mechanism of each vibrator 2 being separated to decrease the interference of ink between respective elastic member 7 as well as to stabilize the ink surface.

In this embodiment, vibrators 2 are formed by depositing Ag electrode 4 of thickness of 1 micron on a substrate 1 made of nickel of thickness of 60 microns, and patterning thereafter, then depositing the piezoelectric ceramic thin film 3 of PZT (lead zirconic acid titanic acid) of thickness of 100 micron, and patterning thereafter, then subsequently depositing the electrodes 5 formed in two layers of 0.05 micron thickness Cr and 1 micron thickness Au and patterning thereafter.

The piezoelectric ceramic thin film 3 made of PZT is polarization processed so as to vibrate in the direction perpendicular to the film plane when a voltage is applied across the electrodes 4 and 5. The electrode 4 is a common electrode common for each vibrator 2, and the electrodes 5 are address electrodes for vibrating specific vibrator.

Thereafter, the vibrators 2 made of piezoelectric ceramic thin film 3 and electrodes 4 and 5 are coated by a protection film 6 of such material as $SiO_2$ of thickness of 1 micron, followed by forming elastic member 7 of cyanoacrylate resin, in the pyramidal form of triangular cross-section, the base of 300 micron boundary, and the hight of 400 micron, on each vibrator 2.

The elastic members 7 are formed by using a mold by forming a concave recess to fluorine resin which is not wet with the cyanoacrylate resin thus not likely to be adhered thereto.

Then, the recesses 26 corresponding to each vibrator 2 on the substrate 1 and the supports 27 positioned therebetween are formed by anisotropically etching a material 25 made of a Si wafer, thereafter the substrate 1 and the member 25 are adhered in the underneath side of the substrate 1 by using supports 27 as contact points or fixing points. The recesses 26 are not closed space, a part thereof should communicate with ambient air. The member 25 will become a support supporting the substrate 1.

The distance between the tip 7*a* of the elastic members 7 and the ink free surface 8*a* of the ink 8 is 100 micron such that the tip 7*a* of the elastic member 7 may protrude above the ink free surface 8*a*.

An isolator 29 made of a fluorine resin is disposed thereafter. The isolator 29 is comprised of a portion 29A for stabilizing the depth and the surface of the ink 8, and of a portion 29B perpendicular to the ink free surface 8*a* so as to isolate ink adjoining to each vibrator 2.

Provision of such an isolator 29 allows each vibrator 2 to be likely not to be affected by vibration from the neighboring vibrators or by the positional change and movement of the ink surface. However a gap should be maintained between the portion 29B and the substrate 1 retaining the vibrators 2. By doing this, the ink 8 itself may relatively freely move between adjoining vibrators. By providing such an isolator structure, it will not inhibit the refill rate of ink after ejection even if the isolator 29 is provided.

In addition, by disposing the isolator 29, the depth of the ink surface is allowed to be stably fixed, and the surface area of the ink is reduced to inhibit evaporation of some ink components to stabilize the ink physics. However, as the spirit of the present invention teaches naturally, the opening shape of the portion 29A of the isolator should be formed such that the surface area of the ink free surface 8*a* which opens around respective elastic member 7 is larger than the diameter of ejected ink drops.

Preferably, the opening shape of the portion 29A is such that the vibration generated in the ink free surface 8*a* after ejection of ink is settled as soon as possible, as well as that the evaporation of ink components is suppressed as much as possible. In view of these conditions, the shape is preferably a round, or a polygon which approximates to a round.

A Si substrate used as the member 25 constituting the support, has the plane azimuth of (100), from which a part of SiN film deposited on the surface of the substrate is removed, then the SiN removed area is etched by using etchant consisting of Pyrocatechol, Ethylene diamine, and water. By such etching, the substrate will be etched at a predetermined angle depending to the plane azimuth of the substrate, as described in "IEEE Transactions of Electron Devices, Vol. ED-25, No. 10 (1978), pp1178.

By using such anisotropic etching, very sharpened supports 27 may be manufactured with high precision. In order for the vibration of each vibrator 2 to be sufficiently large, it will be effective that the thickness of the substrate 1 supporting the vibrators 2 is thinner, and that the contact area of the supports 27 to the substrate 1 is smaller. These facts are commonly applied to other embodiments. More specifically, in order to reduce the contact area of the supports 27 to the substrate 1, the method of forming supports in this embodiment may be useful. It should be noted that the shape of the recesses 26 formed when anisotropically etching will be characteristic.

Figure 13A:
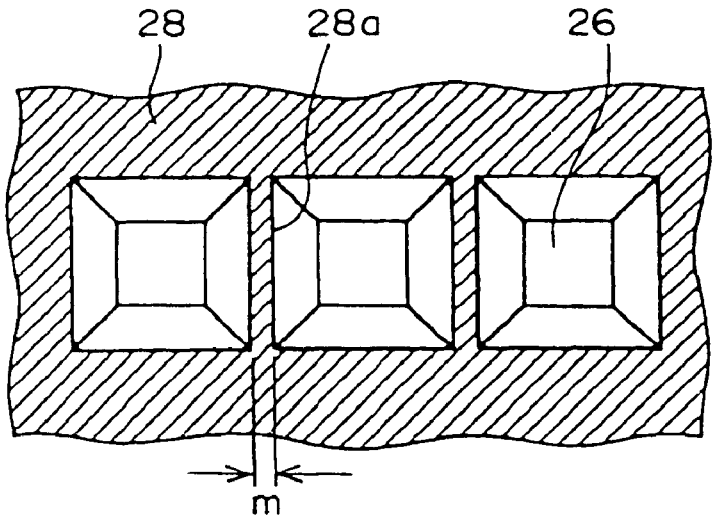
FIG. 13 shows a diagram illustrating the method of producing the recording element shown in FIG. 12.
Figure 13B:
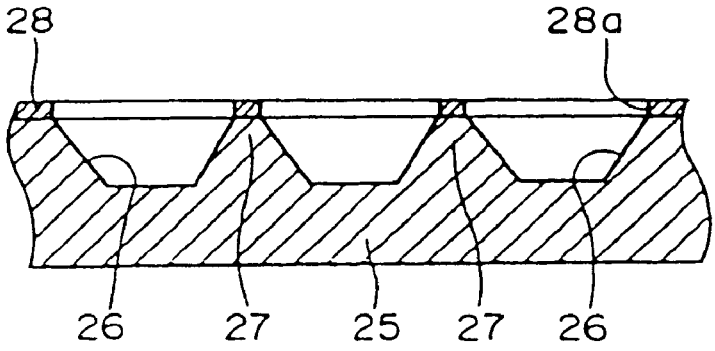

Then, FIG. 13 shows a member 25 consisting of supports 27 and recesses 26 in case in which the member 25 is made of a Si substrate, where FIG. 13A is a plain view, and FIG. 13B is a cross-sectional view. The shape of the holes 28*a* of SiN mask 28 for etching as shown in the figure is in general rectangular or polygon composed of linear boundaries. Thus when the shape is preferred to be approximate to the shape of round recesses, polygon mask having a number of boundaries is to be used. In addition, by narrowing the intervals "m" of the mask 28 separating recesses 26, the tip of thus formed supports 27 will be sharpened as shown in FIG. 12.

For the member having protrusions forming the supports, other crystal inorganic material which possess plane azimuth dependency in the etching speed, such as GaP, SiC, and GaAs, may be used if the protrusions which constitute the supports may be formed by anisotropic etching.

Then by using AC power source not shown to externally apply a voltage of frequency "f" equal to the resonance frequency $f_0$ or a multiple of integer thereof, defined by along with the stiffness of the substrate 1 to the vibrators 2 in order to excite the vibrators 2. In this embodiment a voltage of 32V p-p, at 532 kHz was burstly applied during the period of time of 60 microseconds. As a result, the ink drops 9 of the diameter of 10 microns were ejected only from above the vibrators selected by the address electrodes 5.

In this embodiment, as no nozzle is disposed on the ink surface, needless to say that there was no ink solidified around the nozzle or therewithin, fine ink drops were stably ejected. Since driving frequency is lower, with no heat, the problems such as change of viscosity or solidification of the ink 8 did not occur.

Also similar to the second and third embodiments as shown respectively in FIGS. 10 and 11, there is a recess 26 under each vibrator 2, and the vibrators 2 are supported by their supports 27 at their circumference so that each vibrator 2 may readily vibrate independently, while stably ejecting ink drops without being affected by the distortion of the substrate 1 due to the vibration of neighboring vibrators.

The shape of the recesses 26 may be defined by considering the form of vibrators 2. However, for generation of stable and uniform vibration, a polygon is preferable, and a round is more preferable.

In addition, as the contact area of the supports 27 with the substrate 1 is small, the vibrators 2 may be effectively excited, at the same time the driving voltage may be decreased. Also, by providing the isolator 29, the refill rate of ink after ejection will not be affected. The depth of the ink surface will be stably fixed, and the affection from neighboring vibrators will be decreased so that ink drops may be stably ejected. In addition, the evaporation of some ink components are suppressed by the isolator so that it will stabilize the ink physics, hence the diameter of ejected ink drops.

Figure 14:
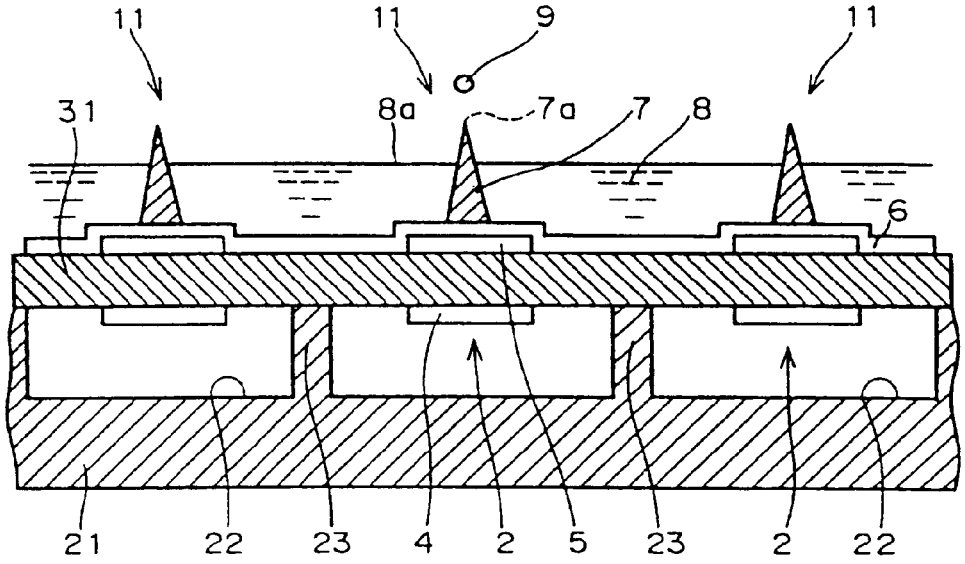
FIG. 14 shows an embodiment of the recording element according to the present invention.

[fifth embodiment: FIG. 14]

FIG. 14 shows the principal members of the fifth embodiment of the recording element according to the present invention. This embodiment is made with a substrate serving for piezoelectric material of the vibrators instead of thin film, and supporting mechanism provided as shown in FIG. 10.

In this embodiment, the vibrators 2 are formed by depositing Ag electrode 4 of thickness of 1 micron on a substrate 31 of PZT having thickness of 500 micron, and patterning thereafter, subsequently depositing the electrodes 5 formed in two layers of 0.05 micron thickness Cr and 1 micron thickness Au and patterning thereafter. The substrate 31 made from PZT is polarization processed so as to vibrate in the direction perpendicular to the film plane when a voltage is applied across the electrodes 4 and 5. The electrode 4 is a common electrode common for each vibrator 2, and the electrodes 5 are address electrodes for vibrating specific vibrator.

Then, the substrate surface at the front side of the substrate 31 and the address electrodes 5 are coated by a protection film 6 of such material as $SiO_2$ of thickness of 1 micron, followed by forming elastic members 7 of cyanoacrylate resin, in the pyramidal form of triangular cross-section, the base of 150 micron boundary, and the height of 200 micron, on each of the vibrators 2.

The elastic members 7 are formed by using a mold by forming a concave recess to fluorine resin which is not wet with the cyanoacrylate resin thus not likely to be adhered thereto.

By processing a member 21 of ceramics to form recesses 22 corresponding to each vibrator 2 on the substrate 1 and supports 23 positioned therebetween, then to adhere the substrate 1 and the vibrators 2 at the back side of the substrate 1 by using the supports 23 as contact points or fixing points. Each of the recesses 22 is not closed space, a part thereof should communicate with ambient air. The member 21 will become a support supporting the substrate 1.

The distance between the tip 7*a* of the elastic members 7 and the ink free surface 8*a* of the ink 8 is 50 micron such that the tip 7*a* of the elastic members 7 may protrude above the ink free surface 8*a*. Then by using AC power source, not shown, to externally apply to the vibrators 2 a voltage of frequency "f" equal to the resonance frequency $f_0$ or a multiple of integer thereof, defined by along with the stiffness of the substrate 1, in order to excite the vibrators 2.

In this embodiment, a voltage of 40V p-p, at 242 kHz was burstly applied during the period of time of 100 microseconds. As a result, the ink drops 9 of the size (diameter) of 15 microns were ejected only from above the vibrators selected by the address electrodes 5.

Also in this embodiment, as no nozzle is disposed on the ink surface, it will be needless to say that there was no ink solidified around the nozzle or therewithin, fine ink drops were stably ejected. Since driving frequency is lower, with no heat, the problems such as change of viscosity or solidification of the ink 8 did not occur.

Furthermore, in this embodiment, there is a recess 22 under each vibrator 2, and the vibrators 2 are supported by the support 23 at their circumference so that each of the vibrators 2 may be easily vibrated independently, while stably ejecting ink drops without being affected by the distortion of the substrate 1 due to the vibration of neighboring vibrators.

Furthermore, in this embodiment, as the piezoelectric material is also used for the substrate 31, the structure will become simple and the manufacturing cost will be less. In addition, the vibration characteristics of the piezoelectric material is uniform in the substrate 31, thus the diameter and speed of ink drops ejected from each ejector 11 corresponding to each vibrator 2 will be uniform in the recording element.

The material for the substrate 31 may be not only ceramics such as PZT, but also crystals such as niobic acid lithium $LiNbO_3$, and crystal. For the supporting mechanism of the substrate 31 the one shown in FIG. 12 may be used in place thereof, and the isolator mechanism as shown in FIG. 12 also may be provided.

Figure 15:
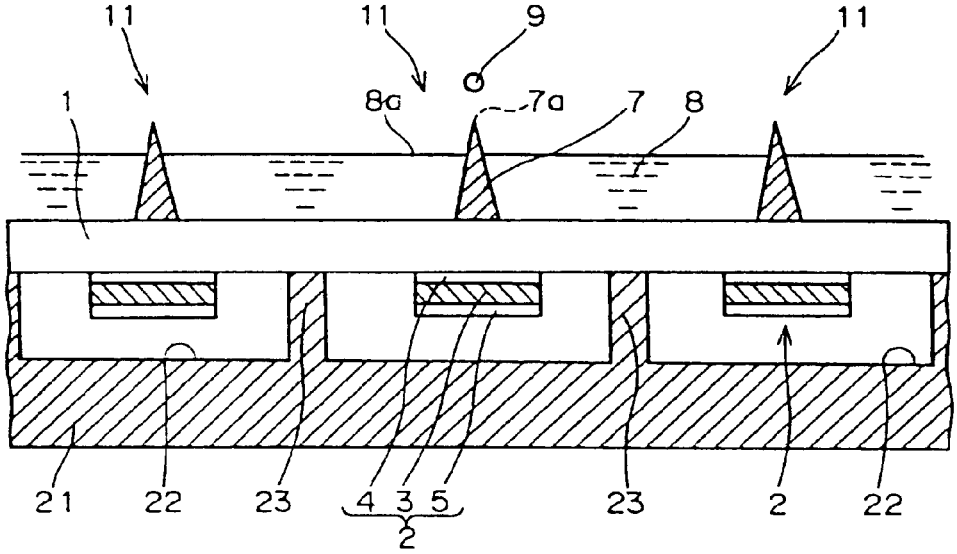
FIG. 15 shows another embodiment of the recording element according to the present invention.

[sixth embodiment: FIG. 15]

FIG. 15 shows the principal members of the sixth embodiment of the recording element according to the present invention. In this embodiment, vibrators and elastic members are provided at respective side of the substrate so as to sandwich the substrate, and supporting mechanism as shown in FIGS. 10 and 14 is provided.

In this embodiment, vibrators 2 are formed by depositing Ag electrode 4 of thickness of 1 micron on a substrate 1 of brass having thickness of 500 micron, and patterning thereafter, then depositing the piezoelectric ceramic thin film 3 of PZT (lead zirconic acid titanic acid) of thickness of 100 micron, and patterning thereafter, then subsequently depositing the electrodes 5 formed in two layers of 0.05 micron thickness Cr and 1 micron thickness Au and patterning thereafter.

The piezoelectric ceramic thin film 3 made of PZT is polarization processed so as to vibrate in the direction perpendicular to the film plane when a voltage is applied across the electrodes 4 and 5. The electrode 4 is a common electrode common for each vibrator 2, and the electrodes 5 are address electrodes for vibrating specific vibrator.

On the surface of the substrate 1, at the position opposite to the vibrators 2 through the substrate 1, the elastic members 7 are formed which is made of cyanoacrylate resin, in the pyramidal form with triangular cross-section, the base of 150 micron boundary, and the height of 200 micron. The elastic members 7 are formed by using a mold by forming a concave recess in fluorine resin which is not wet with the cyanoacrylate resin thus not likely to be adhered thereto.

Then, by processing a member 21 of ceramics, recesses 22 corresponding to each vibrator 2 on the substrate 1 and supports 23 positioned therebetween are formed, then the substrate 1 and the vibrators 2 are adhered at the underneath side of the substrate 1 by using the supports 23 as contact points or fixing points. Each of the recesses 22 is not closed space, a part thereof should communicate with ambient air. The member 21 will become a support supporting the substrate 1.

The distance between the tip 7*a* of the elastic members 7 and the ink free surface 8*a* of the ink 8 is 50 micron such that the tip 7*a* of the elastic members 7 may protrude above the ink free surface 8*a*. Then by using AC power source, not shown, to externally apply to the vibrators 2 a voltage of frequency "f" equal to the resonance frequency $f_0$ or a multiple of integer thereof, defined by along with the stiffness of the substrate 1, in order to excite the vibrators 2.

In this embodiment, a voltage of 40V p-p, at 242 kHz was burstly applied during the period of time of 100 microseconds. As a result, the ink drops 9 of the size (diameter) of 15 microns were ejected only from above the vibrators selected by the address electrodes 5.

Also in this embodiment, as no nozzle is disposed on the ink surface, it may be needless to say that there was no ink solidified around the nozzle or therewithin, fine ink drops were stably ejected. Since driving frequency is lower, with no heat, the problems such as change of viscosity or solidification of the ink 8 did not occur.

Furthermore, in this embodiment, there is a recess 22 under each vibrator 2, and the vibrators 2 are supported by the support 23 at their circumference so that each of the vibrators 2 may be easily vibrated independently, while stably ejecting ink drops without being affected by the distortion of the substrate 1 due to the vibration of neighboring vibrators.

In addition, the vibrators 2 are arranged in the back side of the substrate 1, and the elastic members 7 in the front side of the substrate 1, respectively, so that the vibrators 2 are not exposed to the ink 8. Therefore any protection film such as $SiO_2$ may be eliminated, and since the vibrators 2 are neither corrode nor shortened, very reliable recording element may be obtained.

[seventh embodiment: FIG. 16]

FIG. 16 shows the principal members of the seventh embodiment of the recording element according to the present invention. In this embodiment, elastic members are integral with a piezoelectric substrate.

In this embodiment, the vibrators 2 are formed by depositing electrodes 4 formed in two layers of 0.05 micron thickness Cr and 1 micron thickness Au on the back side of a substrate 31 made of PZT of thickness of 2 mm (in the direction of the arrow "b" in FIG. 16) and patterning thereafter, then subsequently depositing electrodes 5 formed in two layers of 0.05 micron thickness Cr and 1 micron thickness Au on the front side of the substrate 31 and patterning thereafter. The electrodes 4 are coupling common electrodes (coupling section not shown in the figure), while the electrodes 5 are address electrodes for selectively driving each vibrator 2 individually.

Figure 16A:
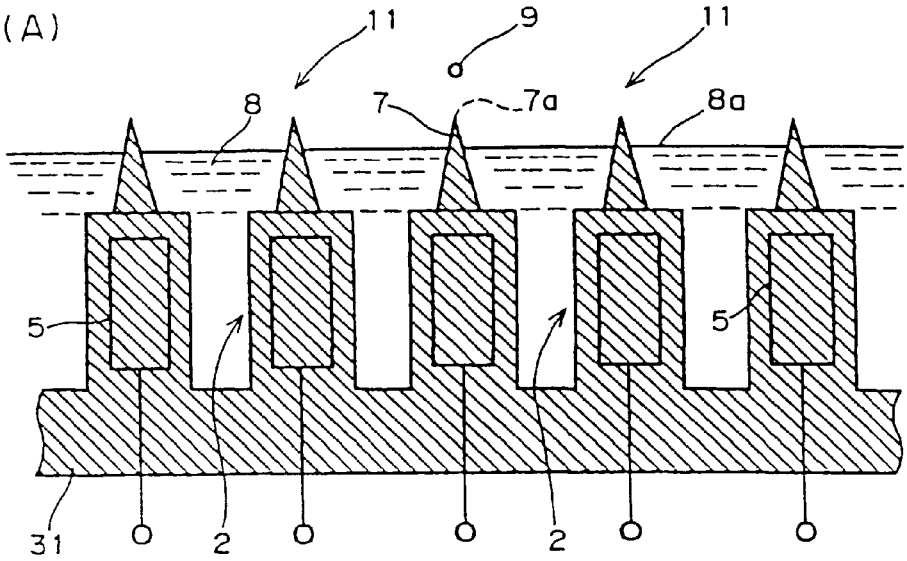
FIG. 16 shows still another embodiment of the recording element according to the present invention.
Figure 16B:
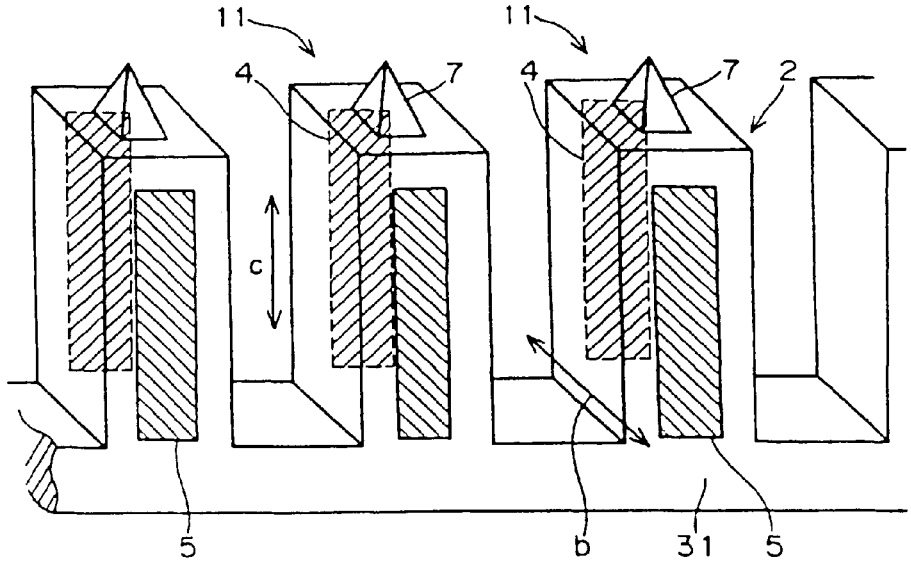

The substrate 31 made from PZT will be polarization processed so as to vibrate and displace in the direction parallel to the substrate plane, i.e., in the direction of the arrow "c" shown in FIG. 16B, when a voltage is applied across the electrodes 4 and 5.

Then, an end surface of the substrate 31 at the upper side in the FIGS. 16A and B are processed by discharging processing to form elastic members 7 having pyramidal shape with approximately triangular cross-section, with the base boundary of 150 micron and hight of 200 micron, at the center of the substrate end surface.

After the elastic members 7 are formed, each vibrator 2 are separated by cutting the substrate 31 with a dicing machine. By means of such a separating manner, the recording elements are produced at low cost, without the need of specially forming any supports with another member, as discussed above in the fifth embodiment shown in FIG. 14.

Although omitted in the figure for the purpose of simplicity, in order to protect the substrate 31, elastic members 7, and electrodes 4 and 5, which are in contact with ink 8, these members are protected by a protection film made of $SiO_2$ of thickness of 1 micron.

The distance between the tip 7*a* of the elastic members 7 and the ink free surface 8*a* of the ink 8 is 100 micron such that the tip 7*a* of the elastic members 7 may protrude above the ink free surface 8*a*.

Then by using AC power source, not shown, to externally apply to the vibrators 2 a voltage of frequency "f" equal to the resonance frequency $f_0$ or a multiple of integer thereof, defined by along with the stiffness of the substrate 1, in order to excite the vibrators 2. In this embodiment, a voltage of 60V p-p, at 500 kHz was burstly applied during the period of time of 100 microseconds. As a result, the ink drops 9 of the diameter of 15 microns were ejected only from above the vibrators selected by the address electrodes 5.

Also in this embodiment, as no nozzle is disposed on the ink surface, it will be needless to say that there was no ink solidified around the nozzle or therewithin, fine ink drops were stably ejected. Since driving frequency is lower, with no heat, the problems such as change of viscosity or solidification of the ink 8 did not occur.

In addition, in this embodiment since each vibrator 2 are mechanically separated, vibrators 2 may stably eject ink drops without being affected by the distortion of the substrate 1 due to the vibration of neighboring vibrators.

Also, in this embodiment, as the piezoelectric material itself is served as the substrate 31, and as each vibrator 2 are separated by cutting the substrate 31, the process of head arrangement and production will become simpler, and the production cost may be less. Also, the vibration characteristics of the piezoelectric material is uniform in the substrate 31, thus the diameter and speed of ink drops ejected from each vibrator 2.

It should be noted that the material for the substrate 31 may be not only ceramics such as PZT, but also crystals such as niobic acid lithium $LiNbO_3$, and crystal. In addition, laminated ceramics, which are laminated as multi-layer of piezoelectric ceramics for increasing the amplitude, may be used for the piezoelectric substrate 31.

For forming elastic members 7 by processing a part of the piezoelectric substrate 31, another processing such as wet etching, and dry etching, or laser process may be used instead of discharging processing.

The method of vibration separating by cutting the piezoelectric substrate 31 with a dicing machine has an advantage that the production process will become simple. After the electrodes 4 and 5 are formed, it may be useful that instead of processing the end portion of the piezoelectric substrate 31, the elastic members 7 may be formed with another material to subsequently cut the piezoelectric substrate 31 with a dicing machine to vibration separate.

Figure 17:
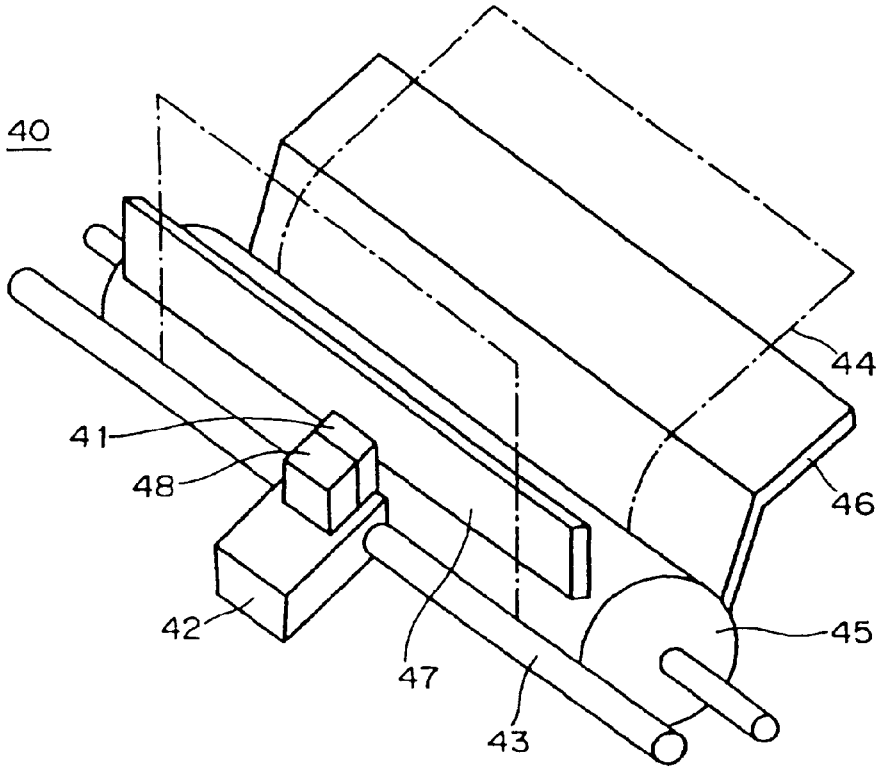
FIG. 17 shows yet another embodiment of the recording element according to the present invention.
Figure 18:
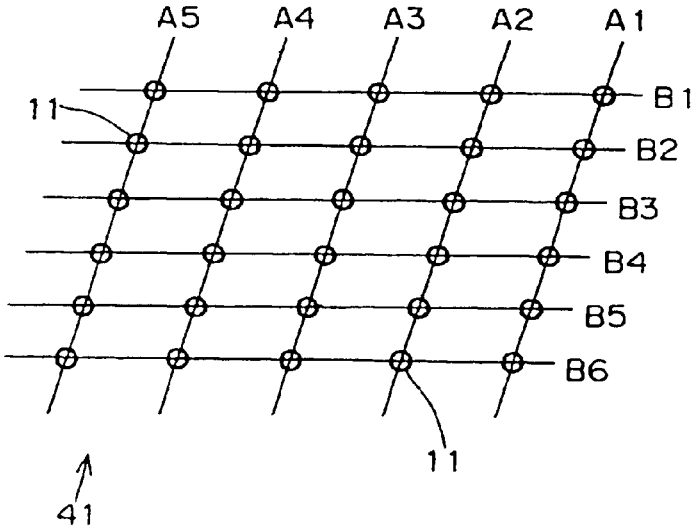
FIG. 18 shows a diagram illustrating the driving type of the recording element shown in FIG. 17.

[eighth embodiment: FIGS. 17 and 18]

FIG. 17 shows the principal members of the eighth embodiment of the recording element according to the present invention.

For a recording device 40 in this embodiment, a recording element 41 as shown in the second embodiment as above may be fixed to a carriage 42. The carriage 42 is guided by a guide 43 to reciprocate in the direction of paper-width of a printing paper 44, and the printing paper 44 are fed along with guides 46 and 47 by the rotation of feeder roller 45 such that an image will be printed on one entire printed surface of the printing paper 44.

The recording element 41 are, as shown in FIG. 18, consisted of ejectors 11, arranged in a quincunx grid pattern on the substrate, which comprises vibrators and elastic members, whereby high density printing may be achieved even when each of vibrators and elastic members is relatively large.

The embodiment as shown in FIG. 18 is an exemplary matrix drive, where leads A1 to A5 are leads from one electrode connected longitudinally to each ejector 11, and leads B1 to B6 are leads from the other electrode connected transversally to each ejector 11. When a voltage is applied between any one of the leads A1 to A5 and any one of the leads B1 to B6, only one ejector is selected to excite.

In the recording device 40 shown in FIG. 17, the feeding speed of the carriage 42 and the interval of each vibrator within the recording element 41 are arranged so as to correspond to 600 dpi (dot per inch) printing.

The recording element 41 comprises four recording elements each corresponding to one of four colors, black, yellow, magenta, and cyan, and are connected to an ink feeder 48. The ink feeder 48 contains inks of four colors of black, yellow, magenta and cyan therewithin.

The ink of each color contained in the ink feeder 48 are respectively supplied to each respective color recording element in the recording device. When a voltage is applied to a vibrator corresponding to an image signal, ink drops are ejected from the ink surface on the selected vibrator to form an image.

Although not shown in the figure, electric signal applied to the recording element 41 are supplied through the carriage 42 from an external device. The driving condition of the recording element 41 is identical to that shown in the second embodiment.

Dots formed on the printing paper 44 after printing were uniform, round dots of approximately 30 microns of diameter, corresponding to the twice of the diameter of ejected ink drops. After continuous printing, neither change in dot size nor ejection problem were occurred.

In pause or stop state in which printing is not performed, the tips of the elastic members are preferably embedded into the ink so as not to be exposed in the air. If the tips of the elastic members are exposed in the air relatively long time, since ink components may evaporate, some ink may be solidified and sticking to the side walls of the elastic members in contact with the ink surface, causing the ejection thereafter to be unstable.

Since the recording device 40 of this embodiment has the recording element 41 according to the present invention, it may stably form fine dots corresponding to some high resolution on the printing paper 44, enabling high quality printing.

The recording elements of the embodiments other than the second embodiment may be used instead for the recording element 41.

Figure 19:
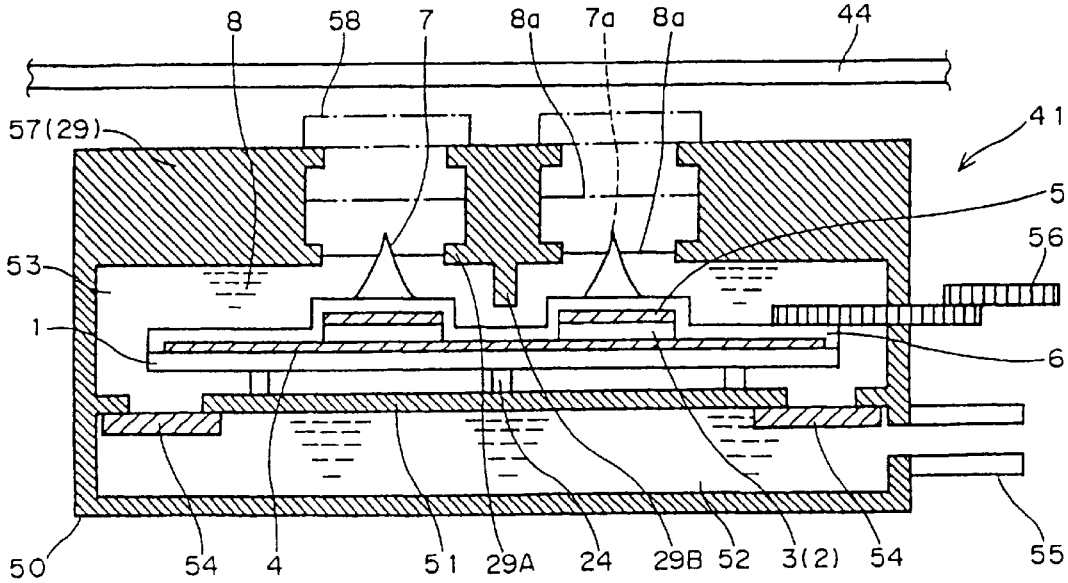
FIG. 19 shows another embodiment of the recording element according to the present invention.

[ninth embodiment: FIG. 19]

FIG. 19 shows another embodiment of the recording device according to the present invention. The recording device in this embodiment is basically similar to the recording device 40 of eighth embodiment as shown in FIG. 17, and the relationship between the recording element 41 and the printing paper 44 is clearly shown by eliminating carriage and other components.

However, the recording device 40 shown in FIG. 17 is arranged to confront the recording element 41 standing up perpendicularly with the printing paper 44. That is, the plane of substrate of the recording element 41 matches with the direction of gravity. In contrast, in the embodiment shown in FIG. 19 the plane of substrate of the recording element 41 is orthogonal to the direction of gravity. Also, in the recording device of this embodiment, such elements as described in the fourth embodiment as shown in FIG. 12 which have the isolator structure are used for the recording element 41.

The recording element 41 of the recording device according to this embodiment provides a plurality of ejectors each comprised of a vibrator 2 and a elastic member 7 on the substrate 1, which ejectors are disposed in an ink reservoir 50. In the ink reservoir 50 a supporting plate 51 is provided. The recording elements 41 arranged on the substrate 1 are supported on the supporting plate 51 through a support 24.

The ink reservoir 50 is split into two parts of ink chambers 52 and 53 by the supporting plate 51. A filter is attached between these two ink chambers 52 and 53. By using a pump not shown, ink 8 is supplied from the ink supply as mentioned above through a tube 55 into the ink chamber 52. The ink 8 supplied to the ink chamber 52 passes through the filter 54 to the ink chamber 53 where the elastic member 7 is disposed. To the vibrators 2 on the substrate 1, driving voltage corresponding to image signals are applied through a flexible cable 56 from an external device.

On the side of the ink reservoir 50 opposite to the printing paper 44 a structure 57 constituting an isolation wall similar to the isolator 29 of FIG. 12 is arranged.

For using this recording device, the supply of the ink 8 to the ink reservoir 50 will be controlled by the pump as mentioned above such that in the ink chamber 53 the ink free surface 8*a* is settled under the tip 7*a* of the elastic member 7 as shown by solid line in the figure.

On the other hand, when the recording device is not used, the supply of the ink 8 to the ink reservoir 50 will be controlled by the pump as mentioned above such that in the ink chamber 53 the ink free surface 8*a* is settled above the tip 7*a* of the elastic member 7 as show by dotted line in the figure.

Thus, when the device is used, since the tip 7*a* of the elastic member 7 is above the ink free surface 8*a,* printing with fine ink drops will be enabled as mentioned above, and when the device is not used, by embedding the elastic member 7 into the ink 8, drying and solidifying of the ink on the surface of the elastic member 7 will be prevented.

In this case, when the device is not used, the openings of the structure 57 may be closed by means of a rubber cap 58 for example so as to prevent dirt and dust from entering from the openings of the structure 57, as well as to prevent ink from evaporating.

In case of the recording element 41 standing up perpendicularly which confronts to the printing paper 44 as the recording device of the embodiment shown in FIG. 17, it may be difficult to uniformly position the ink free surface for all of the elastic members, depending on the viscosity and surface tension of the ink. In contrast, in the recording device of this embodiment, the plane of the substrate of the recording element 41 orthogonally intersects with the direction of gravity, therefore the ink free surface may be distributed uniformly for all of the elastic members, allowing uniform ink drops to be stably ejected from each ejector.

Figure 20:
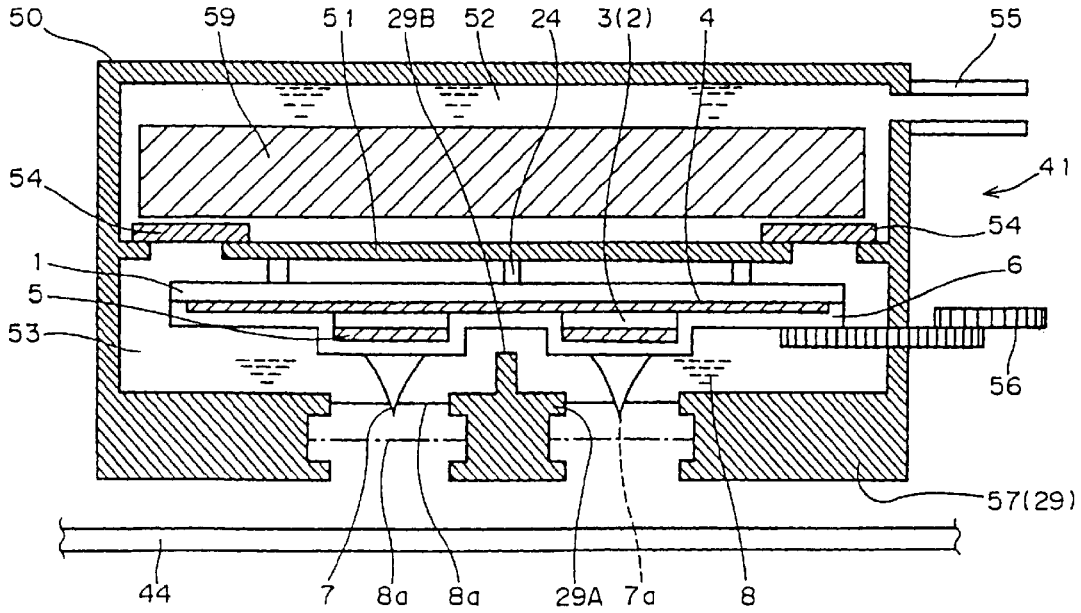
FIG. 20 shows further embodiment of the recording element according to the present invention.
Figure 21:
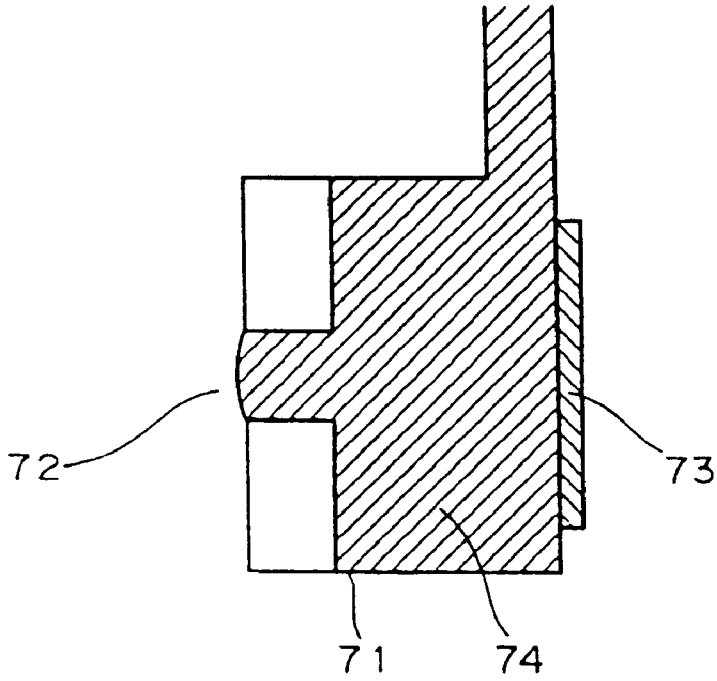
FIG. 21 shows one exemplary embodiment of piezoelectric vibrator type recording element of the prior art.
Figure 22:
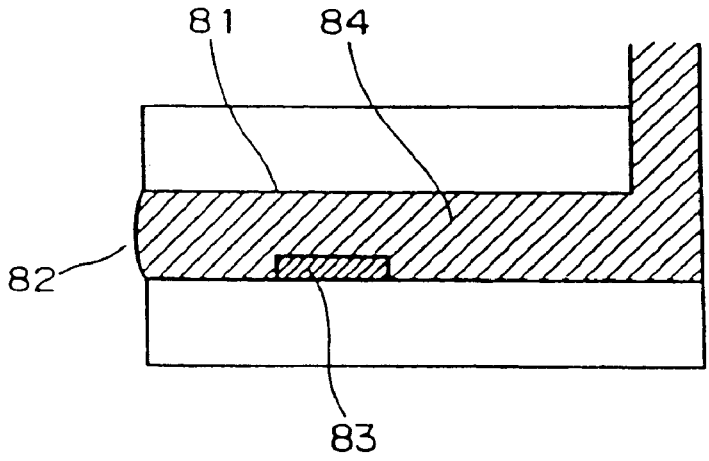
FIG. 22 shows one exemplary embodiment of thermal type recording element of the prior art.

[tenth embodiment: FIG. 20]

FIG. 20 shows another embodiment of the recording device according to the present invention. The recording device of this embodiment is 'upside down' of the recording device of FIG. 19.

Thus, in this embodiment, the ink free surface 8*a* is settled against the gravity. The ink free surface 8*a* may be stably settled against the gravity by optimizing the surface area of the openings of the ink free surface 8*a* and the surface tension of the ink 8.

Here, a sponge 59 is sinked in the ink chamber 52 of the ink reservoir 50. The ink contained the sponge 59 is supplied from the ink chamber 53 to the ink chamber 52 to apply a predetermined force of ink supply against the elastic member 7. Also in this embodiment, the position of the ink free surface 8*a* may be changed depending whether or not the device is operating.

Although in the embodiment shown in FIG. 19, there may be concern that the printing become unstable by the dust or dirt dropped into the ink free surface 8*a* for example due to the scrubbing between the printing paper 44 and feeding rollers, this embodiment is free of such concern.

[other embodiments]

The embodiments as mentioned above are the ones that the present invention is applied to the recording method of printing by ejecting ink drops onto a surface to be printed. The present invention may also be applied to another recording method for performing printing by ejecting other liquid such as water drops onto a recording surface to initiate chemical reaction on the recording surface.

As stated above, according to the present invention, fine liquid drops may be ejected without using any nozzle, more particularly, very fine liquid drops sufficient for the needs of high resolution image may be stably ejected. In addition, the element according to the present invention may be driven with low frequency, low power so that the energy efficiency will become higher and the range of characteristics of usable liquids will be widen.

What is claimed is:

1. A recording element comprising:

an elastic member with a part thereof in contact with a liquid, at least one drop of the liquid being ejected from a portion of the elastic member projecting from a liquid-air interface where the liquid is adjacent a gaseous material, wherein the elastic member does not have an electric potential applied to it.

2. A recording element as set forth in claim 1, in which said elastic member is connected to vibration generator.

3. A recording element as set forth in claim 2, in which said elastic member and said vibration generator are integral.

4. A recording element as set forth in claim 2, in which said vibration generator means is made of a piezoelectric element disposed in one side of a substrate, and a pair of electrodes which may nip the piezoelectric element so that the elastic element is connected to the vibration generator means.

5. A recording element as set forth in claim 4, in which at least one side of said substrate is connected to a support at a periphery of said vibration generator.

6. A recording element as set forth in claim 2, in which said vibration generator is made of a piezoelectric element disposed in a first side of a substrate and a pair of electrodes which may nip the piezoelectric element so that said elastic element is connected to an opposite side to the first side in which said piezoelectric element is disposed.

7. A recording element as set forth in claim 6, in which at least one side of said substrate is connected to a support at the periphery of said vibration generator.

8. A recording element as set forth in claim 2, in which said vibration generator is made of a piezoelectric element, and a pair of electrodes which may nip the piezoelectric element so that the elastic element is connected to a first side of said piezoelectric element.

9. A recording element as set forth in claim 2, in which said vibration generator is driven by burst wave.

10. A recording element as set forth in claim 1, in which said elastic member has a supple tipped portion projecting through the liquid-air interface.

11. A recording element as set forth in claim 1, in which said elastic member has a plate portion projecting through the liquid-air interface.

12. A recording element as set forth in claim 11, in which a singular point is formed at a given position in said plate portion.

13. A recording element as set forth in claim 12, in which said singular point is in the form of a projection.

14. A recording element as set forth in claim 1, in which said elastic member has the portion projecting from the liquid-air interface in the form of a needle.

15. A recording element as set forth in claim 1, in which a partition is provided in a position adjoining the liquid-air interface and within the liquid between at least one neighboring ones of the elastic members.

16. A recording element as set forth in claim 15, in which said partition comprises a portion approximately parallel to the liquid-air interface and a portion approximately perpendicular to the liquid-air interface.

17. A recording element as set forth in claim 1, in which said elastic member is disposed at an intersection between a plurality of electrode wirings aligned in one direction and a plurality of electrode wirings obliquely crossing thereto.

18. A recording element comprising:

an elastic member with a part thereof in contact with a liquid, at least one drop of the liquid being ejected from a portion of the elastic member projecting from a liquid-air interface where the liquid is adjacent a gaseous material, wherein the elastic member is non-conductive.

19. A recording device performing printing by ejecting drops of liquid from a recording element to a printed surface, said recording element being provided with an elastic element having a portion in contact with a liquid, said recording element causing drops of liquid to be ejected from a part of said elastic element projected from a liquid-air interface by vibrating said elastic element, the liquid-air interface positioned where the liquid is adjacent a gaseous material, wherein the elastic member does not have an electric potential applied to it.

20. A recording device as set forth in claim 19, in which means are provided for embedding said elastic element into said liquid when said recording element is not used.

21. A liquid drop generator comprising:

a flexible, non-conductive member extending from a liquid through a liquid-air interface, the liquid-air interface positioned where the liquid is adjacent a gaseous material.

22. The liquid drop generator of claim 21, wherein at least one drop of the liquid is ejected in response to a movement of a movable element connected to the flexible non-conductive member.

23. A printer comprising the liquid drop generator of claim 21.

* * * * *